United States Patent [19]

Shirai et al.

[11] Patent Number: 4,738,913

[45] Date of Patent: Apr. 19, 1988

[54] LIGHT RECEIVING MEMBER FOR USE IN ELECTROPHOTOGRAPHY COMPRISING SURFACE LAYER OF A-SI:C:H

[75] Inventors: Shigeru Shirai; Keishi Saito; Takayoshi Arai; Minoru Kato; Yasushi Fujioka, all of Nagahama, Japan

[73] Assignee: Canon Kabushiki Kaisha, Tokyo, Japan

[21] Appl. No.: 5,884

[22] Filed: Jan. 21, 1987

[30] Foreign Application Priority Data

Jan. 23, 1986 [JP] Japan ..... 61-012881
Feb. 3, 1986 [JP] Japan ..... 61-021642
Feb. 4, 1986 [JP] Japan ..... 61-022547

[51] Int. Cl.[4] ..... G03G 5/082

[52] U.S. Cl. ..... 430/67; 430/57; 430/63; 430/65

[58] Field of Search ..... 430/63, 57, 65, 66

[56] References Cited

U.S. PATENT DOCUMENTS 4,289,822 9/1981 Shimada et al. ..... 428/212
4,565,731 1/1986 Komatsu et al. ..... 428/212
4,659,639 4/1987 Mizuno ..... 430/85
4,675,265 6/1987 Kazama et al. ..... 430/65

*Primary Examiner*—J. David Welsh
*Attorney, Agent, or Firm*—Fitzpatrick, Cella, Harper & Scinto

[57] ABSTRACT

There is provided an improved light receiving member for use in electrophotography comprising a substrate for electrophotography and a light receiving layer constituted by a charge injection inhibition layer, a photoconductive layer and a surface layer, the charge injection inhibition layer being formed of an amorphous material containing silicon atoms as the main constituent atoms and an element for controlling the conductivity, the photoconductive layer being formed of an amorphous material containing silicon atoms as the main constituent atoms and at least one kind selected from hydrogen atoms and halogen atoms and the surface layer being formed of an amorphous material containing silicon atoms, carbon atoms and hydrogen atoms, and the amount of the hydrogen atoms contained in the surface layer being in the range from 41 to 70 atomic %.

12 Claims, 14 Drawing Sheets

(A)

(B)

(C)

LIGHT RECEIVING MEMBER FOR USE IN ELECTROPHOTOGRAPHY COMPRISING SURFACE LAYER OF A-SI:C:H

FIELD OF THE INVENTION

This invention relates to an improved light receiving member for use in electrophotography which is sensitive to electromagnetic waves such as light (which herein means in a broader sense those lights such as ultra-violet rays, visible rays, infrared rays, X-rays and γ-rays).

BACKGROUND OF THE INVENTION

For the photoconductive material to constitute a light receiving layer in a light receiving member for use in electrophotography, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon use.

Especially, in the case where it is the light receiving member to be applied in an electrophotographic machine for use in office, causing no pollution is indeed important.

From these standpoints, the public attention has been focused on light receiving members comprising amorphous materials containing silicon atoms (hereinafter referred to as "a—Si"), for example, as disclosed in Offenlegungsschriftes Nos. 2746967 and 2855718 which disclose use of the light receiving member as an image-forming member in electro- photography.

For the conventional light receiving members comprising a—Si materials, there have been made improvements in their optical, electric and photoconductive characteristics such as dark resistance, photosensitivity, and photoresponsiveness, use-environmental characteristics, economic stability and durability.

However, there are still left subjects to make further improvements in their characteristics in the synthesis situation in order to make such a light receiving member practically usable.

For example, in the case where such conventional light receiving member is employed in the light receiving member for use in electrophotography with aiming at heightening the photosensitivity and dark resistance, there are often observed a residual voltage on the conventional light receiving member upon use, and when it is repeatedly used for a long period of time, fatigues due to the repeated use will be accumulated to cause the so-called ghost phenomena inviting residual images Further, in the preparation of the light receiving layer of the conventional light receiving member for use in electrophotography using an a—Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in the light receiving layer.

However, the resulting light receiving layer sometimes becomes accompanied with defects on the electrical characteristics, photoconductive characteristics and/or breakdown voltage according to the way of the incorporation of said constituents to be employed.

That is, in the case of using the light receiving member having such light receiving layer, the life of a photocarrier generated in the layer with the irradiation of light is not sufficient, the inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are apt to appear on the transferred images on a paper sheet.

Further, in the case where the above light receiving member is used in a much moist atmosphere, or in the case where after being placed in that atmosphere it is used, the so-called "image flow" sometimes appears on the transferred images on a paper sheet.

In consequence, it is necessitated not only to make a further improvement in an a—Si material itself but also to establish such a light receiving member not to invite any of the foregoing problems.

SUMMARY OF THE INVENTION

The object of this invention is to provide a light receiving member for use in electrophotography which has a light receiving layer mainly composed of a—Si, free from the foregoing problems and capable of satisfying various kind of requirements in electrophotography.

That is, the main object of this invention is to provide a light receiving member for use in electrophotography which has a light receiving layer formed of a—Si, such that electrical, optical and photoconductive properties are always substantially stable scarcely depending on the working circumstances, and that is excellent against optical fatigue, causes no degradation upon repeating use, excellent in durability and moisture-proofness and exhibits no or scarce residual voltage.

Another object of this invention is to provide a light receiving member for use in electrophotography which has light receiving layer formed of a—Si which is excellent in the close bondability with a substrate on which the layer is disposed or between each of the laminated layers, dense and stable in view of the structural arrangement and is of high quality.

A further object of this invention is to provide a light receiving member for use in electrophotography which has a light receiving layer formed of a—Si which exhibits a sufficient charge-maintaining function in the electrification process of forming electrostatic latent images and excellent electrophotographic characteristics when it is used in electrophotographic method.

A still further object of this invention is to provide a light receiving member for use in electrophotography which has a light receiving layer formed of a—Si which invites neither an image defect nor an image flow on the resulting visible images on a paper sheet upon repeated use in a long period of time and which gives highly resolved visible images with clearer half-tone which are highly dense and quality.

Another object of this invention is to provide a light receiving member for use in electrophotography which has a light receiving layer formed of a—Si which has a high photosensitivity, high S/N ratio and high electrical voltage withstanding property.

The present inventors have made earnest studies for overcoming the foregoing problems on the conventional light receiving members for use in electrophotography and attaining the objects as described above and, as a result, have accomplished this invention based on the finding as described below.

That is, in order to overcome the foregoing problems on the conventional light receiving member for use in electrophotography and attaining the above-mentioned objects, the present inventors have made various studies while focusing on its surface layer. As a result, the present inventors have found that when the surface layer is formed of an amorphous material containing silicon atoms, carbon atoms and hydrogen atoms and the content of the hydrogen atoms is controlled to be ranging in the range between 41 and 70 atomic %, those problems on the conventional light receiving member for use in electrophotography can be satisfactorily eliminated and the above-mentioned objects can be effectively attained.

Accordingly, this invention is to provide a light receiving member for use in electrophotography basically comprising a substrate usable for electrophotography, a light receiving layer comprising a charge injection inhibition layer being formed of an amorphous material containing silicon atoms as the main constituent atoms and an element for controlling the conductivity, a photoconductive layer being formed of an amorphous material containing silicon atoms as the main constituent atoms and at least one kind selected from hydrogen atoms and halogen atoms [hereinafter referred to as "A—Si(H,X)"], and a surface layer having a free surface being formed of an amorphous material containing silicon atoms, carbon atoms and hydrogen atoms (hereinafter referred to as "A—Si:C:H") in which the amount of the hydrogen atoms to be contained is ranging from 41 to 70 atomic %.

It is possible for the light receiving member according to this invention to have an absorption layer for light of long wavelength (hereinafter referred to as "IR layer") being formed of an amorphous material containing silicon atoms and germanium atoms, and if necessary, at least either hydrogen atoms or halogen atoms [hereinafter referred to as "A—SiGe (H,X)"] between the substrate and the charge injection inhibition layer.

It is also possible for the light receiving member according to this invention to have a contact layer formed of an amorphous material containing silicon atoms and at least one kind selected from nitrogen atoms, oxygen atoms and carbon atoms, and if necessary, at least either hydrogen atoms or halogen atoms [hereinafter referred to as "A—Si (N,O,C)(H,X)"] between the substrate and the IR layer or between the substrate and the charge injection inhibition layer.

And, the above-mentioned photoconductive layer may contain oxygen atoms or/and nitrogen atoms. The above-mentioned charge injection inhibition layer is so structured that it contains the element for controlling the conductivity as the layer constituent either in the state of being distributed uniformly in the thicknesswise direction or in the state of being distributed largely in the local layer region near the substrate. Further, the charge injection inhibition layer may contain at least one kind selected from nitrogen atoms, oxygen atoms and carbon atoms as the constituent atoms either in the state of being distributed uniformly in the thicknesswise direction or in the state of being distributed largely in the local layer region near the substrate.

The above-mentioned IR layer may contain at least one kind selected from nitrogen atoms, oxygen atoms, carbon atoms, and an element for controlling the conductivity as the layer constituent.

The light receiving member having the above-mentioned light receiving layer for use in electrophotography according to this invention is free from the foregoing problems on the conventional light receiving members for use in electrophotography, has a wealth of practically applicable excellent electric, optical and photoconductive characteristics and is accompanied with an excellent durability and satisfactory use environmental characteristics.

Particularly, the light receiving member for use in electrophotography according to this invention has substantially stable electric characteristics without depending on the working circumstances, maintains a high photosensitivity and a high S/N ratio and does not invite any undesirable influence due to residual voltage even when it is repeatedly used for along period of time. In addition, it has sufficient moisture resistant and optical fatigue resistance, and cause neither degradation upon repeating use nor any defect on breakdown voltage.

Because of this, according to the light receiving member for use in electrophotography of this invention, even upon repeated use for a long period of time, highly resolved visible images with clearer half tone which are highly dense and quality are stably obtained.

DETAILED DESCRIPTION OF THE INVENTION

Figure 1A:
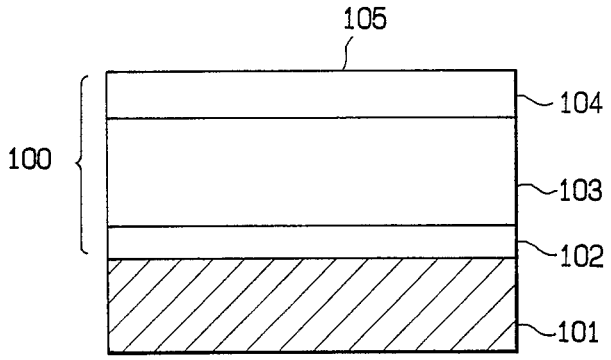
FIG. 1(A) through FIG. 1(D) are schematic views illustrating the typical layer constitution of a representative light receiving member for use in electrophotography according to this invention.

Representative embodiments of the light receiving member for use in electrophotography according to this invention will now be explained more specifically referring to the drawings. The description is not intended to limit the scope of this invention.

Representative light receiving members for use in electrophotography according to this invention are as shown in FIG. 1(A) through FIG. 1(D), in which are shown light receiving layer 100, substrate 101, charge injection inhibition layer 102, photoconductive layer 103, surface layer 104, free surface 105, IR layer 106, and contact layer 107.

FIG. 1(A) is a schematic view illustrating a typical representative layer constitution of this invention, in which is shown the light receiving member comprising the substrate 101 and the light receiving layer 100 constituted by the charge injection inhibition layer 102, the photoconductive layer 103 and the surface layer 104.

Figure 1B:
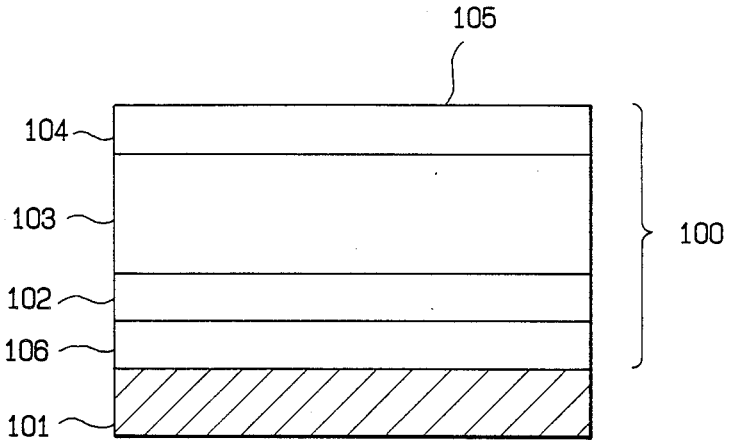

FIG. 1(B) is a schematic view illustrating another representative layer constitution of this invention, in which is shown the light receiving member comprising the substrate 101 and the light receiving layer 100 constituted by the IR layer 106, the charge injection inhibition layer 102, the photoconductive layer 103 and the surface layer 104.

Figure 1C:
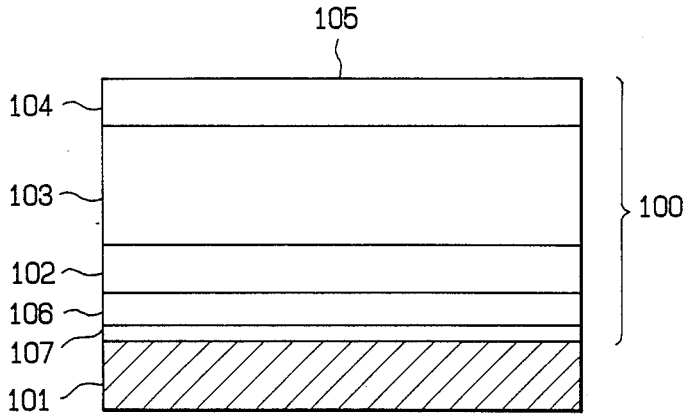

FIG. 1(C) is a schematic view illustrating another represntative layer constitution of this invention, in which is shown the light receiving member comprising the substrate 101 and the light receiving layer 100 constituted by the contact layer 107, the IR layer 106, the charge injection inhibition layer 102, the photoconductive layer 103 and the surface layer 104.

Figure 1D:
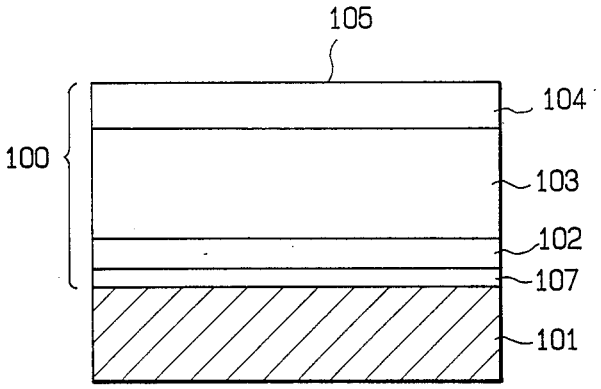

FIG. 1(D) is a schematic view illustrating another representative layer constitution of this invention, in which is shown the light receiving member comprising the substrate 101 and the light receiving layer constituted by the contact layer 107, the charge injection inhibition layer 102, the photoconductive layer 103 and the surface layer 104.

Now, explanation will be made for the substrate and each constituent layer in the light receiving member of this invention.

Substrate 101

The substrate 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, polypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 in continuous high speed reproduction, it is desirably configurated into an endless belt or cylindrical form.

The thickness of the support member is properly determined so that the light receiving member as desired can be formed.

In the case where flexibility is required for the light receiving member, it can be made as thin as possible within a range capable of sufficiently providing the function as the substrate. However, the thickness is usually greater than 10 μm in view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image formation is carried out using coherent monochromatic light such as laser beams.

In that case, the uneven surface shape of the substrate can be formed by the grinding work with means of an appropriate cutting tool, for example, having a V-form bite.

That is, said cutting tool is firstly fixed to the predetermined position of milling machine or lathe, then, for example, a cylindrical substrate is moved regularly in the predetermined direction while being rotated in accordance with the predetermined program to thereby obtain a surface-treated cylindrical substrate of a surface having irregularities in reverse V-form with a desirably pitch and depth.

The irregularities thus formed at the surface of the cylindrical substrate form a helical structure along the center axis of the cylindrical substrate. The helical structure making the reverse V-form irregularities of the surface of the cylindrical substrate may be double or treble. Or otherwise, it may be of a cross-helical structure.

Further, the irregularities at the surface of the cylindrical substrate may be composed of said helical structure and a delay line formed along the center axis of the cylindrical substrate. The cross-sectional form of the convex of the irregularity formed at the substrate surface is in a reverse V-form in order to attain controlled unevenness of the layer thickness in the minute column for each layer to be formed and secure desired close bondability and electric contact between the substrate and the layer formed directly thereon.

And it is desirable for the reverse V-form to be an equilateral triangle, right-angled triangle or inequilateral triangle. Among these triangle forms, equilateral triangle form and right-angled triangle form are most preferred.

Each dimension of the irregularities to be formed at the substrate surface under the controlled conditions is properly determined having a due regard on the following points.

That is, firstly, a layer composed of a—Si(H,X) to constitute a light receiving layer is structurally sensitive to the surface state of the layer to be formed and the layer quality is apt to largely change in accordance with the surface state.

Therefore, it is necessary for the dimension of the irregularity to be formed at the substrate surface to be determined not to invite any decrease in the layer quality of the layer composed of a—Si(H,X).

Secondly, should there exist extreme irregularities on the free surface of the light receiving layer, cleaning in the cleaning process after the formation of visible images becomes difficult to sufficiently carry out. In addition, in the case of carrying out the cleaning with a blade, the blade will be soon damaged.

From the viewpoints of avoiding the problems in the layer formation and the electrophotographic processes, and from the conditions to prevent occurrence of the problems due to interference fringe patterns, the pitch of the irregularity to be formed at the substrate surface is preferably 0.3 to 500 μm, more preferably 1.0 to 200 μm, and, most preferably, 5.0 to 50 μm.

As for the maximum depth of the irregularity, it is preferably 0.1 to 5.0 μm, more preferably 0.3 to 3.0 μm, and, most preferably, 0.6 to 2.0 μm.

And when the pitch and the depth of the irregularity lie respectively in the above-mentioned range, the inclination of the slope of the dent (or the linear convex) of the irregularity is preferably 1° to 20°, more preferably 3° to 15°, and, most preferably, 4° to 10°.

Further, as for the maximum figure of a thickness difference based on the ununiformity in the layer thickness of each layer to be formed on such substrate surface, in the meaning within the same pitch, it is preferably 0.1 to 2.0 μm, more preferably 0.1 to 1.5 μm, and, most preferably, 0.2 μm to 1.0 μm.

Alternatively, the irregularity at the substrate surface may be composed of a plurality of fine spherical dimples which are more effective in eliminating the occurrence of defective images caused by the interference fringe patterns especially in the case of using coherent monochromatic light such as laser beams.

In that case, the scale of each of the irregularities composed of a plurality of fine spherical dimples is smaller than the resolving power required for the light receiving member for use in electrophotography.

Figure 22:
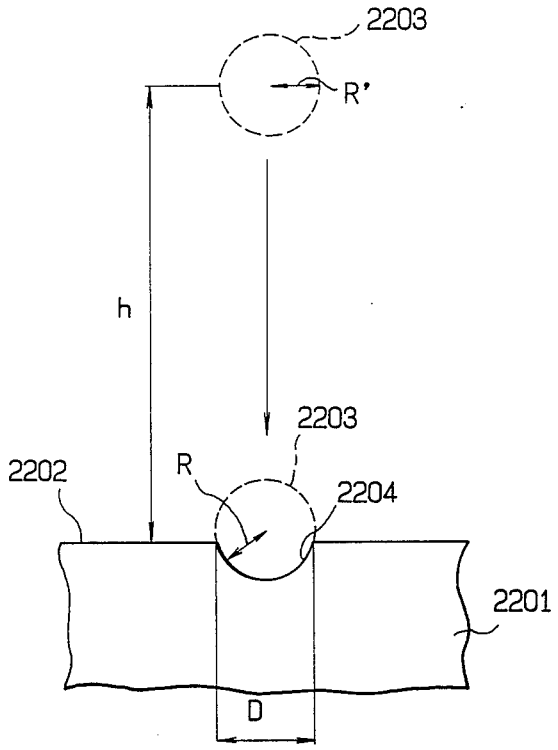
FIGS. 22 through 23 are schematic explanatory views of a preferred method for preparing the substrate having the preferred surface used in the light receiving member shown in FIG. 21.
Figure 23:
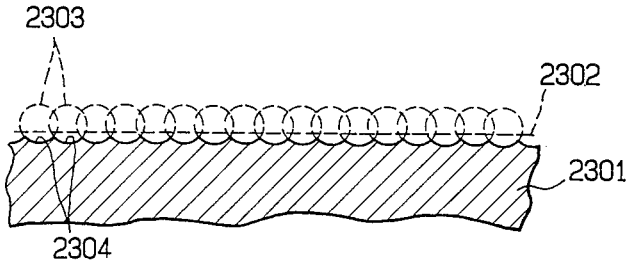

A typical method of forming the irregularities composed of a plurality of fine spherical dimples at the substrate surface will be hereunder explained referring to FIGS. 22 and 23.

FIG. 22 is a schematic view for a typical example of the shape at the surface of the substrate in the light receiving member for use in electrophotography according to this invention, in which a portion of the uneven shape is enlarged. In FIG. 22, are shown a support 2201, a support surface 2202, a rigid true sphere 2203, and a spherical dimple 2204.

FIG. 22 also shows an example of the preferred methods of preparing the surface shape as mentioned above. That is, the rigid true sphere 2203 is caused to fall gravitationally from a position at a predetermined height above the substrate surface 2202 and collide against the substrate surface 2202 to thereby form the spherical dimple 2204. A plurality of fine spherical dimples 2204 each substantially of an identical radius of curvature R and of an identical width D can be formed to the substrate surface 2202 by causing a plurality of rigid true spheres 2203 substantially of an identical diameter R' to fall from identical height h simultaneously or sequentially.

FIG. 23 shows a typical embodiment of a substrate formed with the uneven shape composed of a plurality of spherical dimples at the surface as described above.

In the embodiment shown in FIG. 23, a plurality of dimples pits 2304, 2304 . . . substantially of an identical radius of curvature and substantially of an identical width are formed while being closely overlapped with each other thereby forming an uneven shape regularly by causing to fall a plurality of spheres 2303, 2303, . . . regularly and substantially from an identical height to different positions at the surface 2302 of the support 2301. In this case, it is naturally required for forming the dimples 2304, 2304 . . . overlapped with each other that the spheres 2303, 2303 . . . are graviationally dropped such that the times of collision of the respective spheres 2303 to the support 2302 and displaced from each other.

By the way, the radius of curvature R and the width D of the uneven shape formed by the spherical dimples at the substrate surface of the light receiving member for use in electrophotography according to this invention constitute an important factor for effectively attaining the advantageous effect of preventing occurrence of the interference fringe in the light receiving member for use in electrophotography according to this invention. The present inventors carried out various experiments and, as a result, found the following facts.

That is, if the radius of curvature R and the width D satisfy the following equation:

$$D/R \geqq 0.035$$

0.5 or more Newton rings due to the sharing interference are present in each of the dimples. Further, if they satisfy the following equation:

$$D/R > 0.055$$

one or more Newton rings due to the sharing interference are present in each of the dimples.

From the foregoing, it is preferred that the ratio D/R is greater than 0.035 and, preferably, greater than 0.055 for dispersing the interference fringes resulted throughout the light receiving member in each of the dimples thereby preventing occurrence of the interference fringe in the light receiving member.

Further, it is desired that the width D of the unevenness formed by the scraped dimple is about 500 μm at the maximum, preferably, less than 200 μm and, more preferably less than 100 μm.

Figure 21:
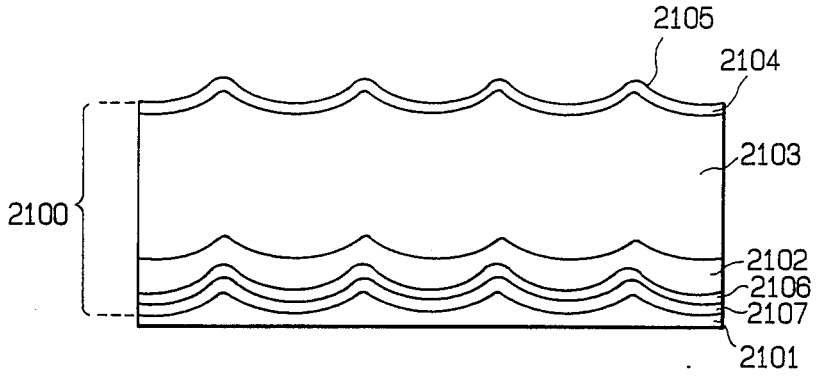
FIG. 21 is a schematic view for a preferred example of the light receiving member for use in electrophotography according to this invention which has a light receiving layer as shown in FIG. 1(C) formed on the substrate having a preferred surface.

FIG. 21 is a schematic view illustrating a representative embodiment of the light receving member in which is shown the light receiving member comprising the above-mentioned substrate and the light receiving layer 100 constituted by contact layer 2107, IR layer 2106, charge injection inhibition layer 2102, photoconductive layer 2103, and surface layer 2104 having free surface 2105.

Contact Layer 107 (or 2107)

The contact layer 107 (or 2107) of this invention is formed of an amorphous material containing silicon atoms, at least one kind selected nitrogen atoms, oxygen atoms and carbon atoms, and if necessary, hydrogen atoms or/and halogen atoms.

Further, the contact layer may contain an element for controlling conductivity.

The main object of disposing the contact layer in the light receiving member of this invention is to enhance the bondability between the substrate and the charge injection inhibition layer or between the substrate and the IR layer. And, when the element for controlling the conductivity is incorporated in the contact layer, the transportation of a charge between the substrate and the charge injection inhibition layer is effectively improved.

For incorporating various atoms in the contact layer, that is, at least one kind selected from nitrogen atoms, oxygen atoms and carbon atoms; elements for controlling the conductivity in case where necessary; they may be distributed either uniformly in the entire layer region or unevenly in the direction toward its layer thickness.

In the light receiving member of this invention, the amount of nitrogen atoms, oxygen atoms, or carbon atoms to be incorporated in the contact layer is properly determined according to use purposes.

It is preferably $5\times10^{-4}$ to $7\times10$ atomic %, more preferably $1\times10^{-3}$ to $5\times10$ atomic %, and, most preferably, $2\times10^{-3}$ to $3\times10$ atomic %.

For the thickness of the contact layer, it is properly determined having a due regard to its bondability, charge transporting efficiency, and also to its producibility.

It is preferably $1\times10^{-2}$ to $1\times10$ μm, and, most preferably, $2\times10^{-2}$ to 5 μm.

As for the hydrogen atoms and halogen atoms to be optionally incorporated in the contact layer, the amount of hydrogen atoms or halogen atoms, or the sum of the amount of hydrogen atoms and the amount of halogen atoms in the contact layer is preferably $1\times10^{-1}$ to $7\times10$ atomic %, more preferably $5\times10^{-1}$ to $5\times10$ atomic %, and, most preferably, 1 to $3\times10$ atomic %.

IR Layer 106 (or 2106)

In the light receiving member for use in electrophotography of this invention, the IR layer is formed of A—SiGe (H,X), and it is disposed directly on the above-mentioned substrate or on the above-mentioned contact layer.

As for the germanium atoms to be contained in the IR layer, they may be distributed uniformly in its entire layer region or unevenly in the direction toward the layer thickness of its entire layer region.

But in any case, it is necessary for the germanium atoms to be distributed uniformly in the direction parallel to the surface of the substrate in order to provide the uniformness of the characteristics to be brought out.

(Herein or hereinafter, the uniform distribution means that the distribution of germanium atoms in the layer is uniform both in the direction parallel to the surface of the substrate and in the thickness direction. The uneven distribution means that the distribution of germanium atoms in the layer is uniform in the direction parallel to the surface of the substrate but is uneven in the thickness direction.)

That is, in the case in where the germanium atoms contained unevenly in the direction toward the layer thickness of its entire layer region, the germanium atoms are incorporated so as to be in the state that these atoms are more largely distributed in the layer region near the substrate than in the layer apart from the substrate (namely in the layer region near the free surface of the light receiving layer) or in the state opposite to the above state.

In preferred embodiments, the germanium atoms are contained unevenly in the direction toward the layer thickness of the entire layer region of the IR layer.

In one of the preferred embodiments, the germanium atoms are contained in such state that the distributing concentration of these atoms is changed in the way of being decreased from the layer region near the substrate toward the layer region near the charge injection inhibition layer. In this case, the affinity between the IR layer and the charge injection inhibition becomes excellent. And, as later detailed, when the distributing concentration of the germanium atoms is made significantly large in the layer region adjacent to the substrate, the IR layer is enhanced to substantially and completely absorb the light of long wavelength that can be hardly absorbed by the photoconductive layer in the case of using a semiconductor laser as the light source. As a result, the occurrence of the interference caused by the light reflection from the surface of the substrate can be effectively prevented.

Explanation will be made to the typical embodiments of the distribution of germanium atoms to be contained unevenly in the direction toward the layer thickness of the IR layer while referring to FIGS. 2 through 7 showing the distribution of germanium atoms. However, this invention is no way limited only to these embodiments.

In FIGS. 2 through 7, the abscissa represent the distribution concentration C of germanium atoms and the ordinate represents the thickness of the IR layer; and $t_B$ represents the extreme position of the IR layer containing germanium atoms is formed from the $t_B$ side toward the $t_T$ side.

Figure 2:
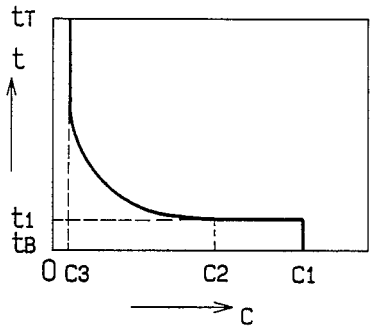
FIG. 2 through FIG. 7 are views illustrating the thicknesswise distribution of germanium atoms in the IR layer.

FIG. 2 shows the first typical example of the thicknesswise distribution of the germanium atoms in the IR layer. In this example, germanium atoms are distributed such that the concentration C remains constant at a value $C_1$ in the range from position $t_B$ (at which the IR layer comes into contact with the substrate) to position $t_1$, and the concentration C gradually and continuously decreases from $C_2$ in the range from position $t_1$ to position $t_T$, where the concentration of the germanium atoms is $C_3$.

Figure 3:
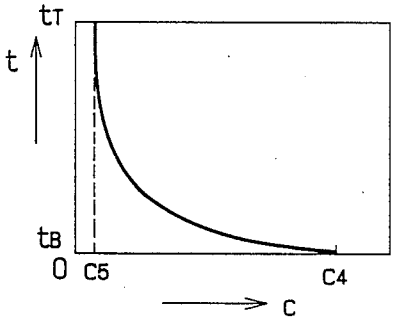

In the example shown in FIG. 3, the distribution concentration C of the germanium atoms contained in the IR layer is such that concentration $C_4$ at position $t_B$ continuously decreases to concentration $C_5$ at position $t_T$.

Figure 4:
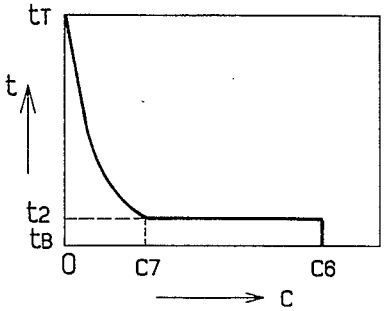

In the example shown in FIG. 4, the distribution concentration C of the germanium atoms is such that the concentration $C_6$ remains constant in the range from position $t_B$ and position $t_2$ and it gradually and continuously decreases in the range from position $t_2$ and position $t_T$. The concentration at position $t_T$ is substantially zero. ("Substantially zero" means that the concentration is lower than the detectable limit.)

Figure 5:
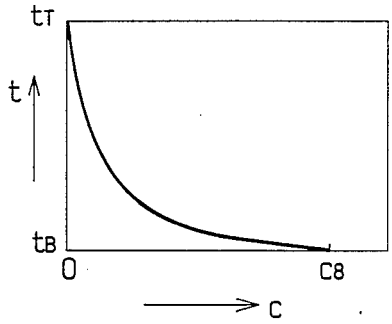

In the example shown in FIG. 5, the distribution concentration C of the germanium atoms is such that concentration $C_8$ gradually and continuously decreases in the range from position $t_B$ and position $t_T$, at which it is substantially zero.

Figure 6:
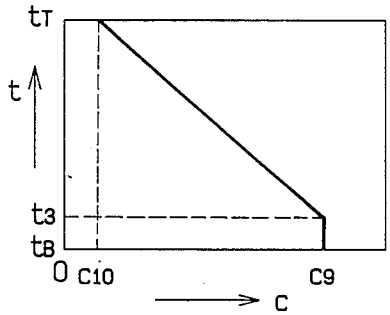

In the example shown in FIG. 6, the distribution concentration C of the germanium atoms is such that concentration $C_9$ remains constant in the range from position $t_B$ to position $t_3$, and concentration $C_9$ linearly decreases to concentration $C_{10}$ in the range from position $t_3$ to position $t_T$.

Figure 7:
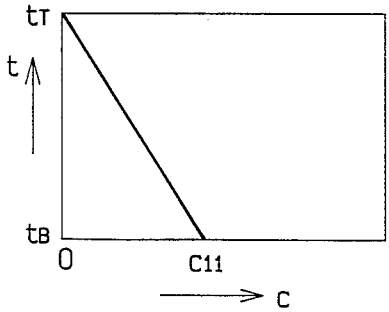
Figure 8:
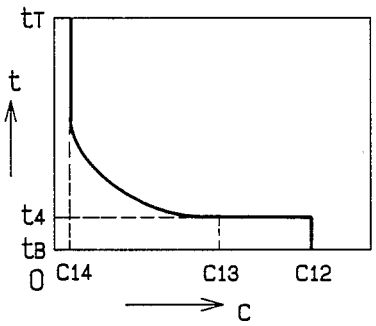
FIG. 8 through FIG. 12 are views illustrating the thicknesswise distribution of the group III atoms or the group V atoms in the charge injection inhibition layer.

In the example shown in FIG. 7, the distribution concentration C of the germanium atoms is such that concentration $C_{11}$ linearly decreases in the range from position $t_B$ to position $t_T$, at which the concentration is substantially zero.

Several examples of the thicknesswise distribution of germanium atoms in the IR layer are illustrated in FIGS. 2 through 7. In the light receiving member of this invention, the concentration (C) of germanium atoms in the IR layer is preferred to be high at the position adjacent to the substrate and considerably low at the position adjacent to the interface $t_T$.

The thicknesswise distribution of germanium atoms contained in the IR layer is such that the maximum concentration $C_{max}$ of germanium atoms is preferably greater than $1\times10^3$ atomic ppm, more preferably greater than $5\times10^3$ atomic ppm, and most preferably, greater than $1\times10^4$ atomic ppm based on the total amount of silicon atoms and germanium atoms.

For the amount of germanium atoms to be contained in the IR layer, it is properly determined according to desired requirements. However, it is preferably 1 to $1\times10^6$ atomic ppm, more preferably $10^2$ to $9.5\times10^5$ atomic ppm, and, most preferably, $5\times10^2$ to 2 to $8\times10^5$ atomic ppm based on the total amount of silicon atoms and germanium atoms.

Further, the IR layer may contain at least one kind selected from the element for controlling the conductivity, nitrogen atoms, oxygen atoms and carbon atoms.

In that case, its amount is preferably $1\times10^2$ to $4\times10$ atomic %, more preferably $5\times10^{-2}$ to $3\times10$ atomic %, and most preferably $1\times10^{-1}$ to 25 atomic %.

As for the element for controlling the conductivity, so-called impurities in the field of the semiconductor can be mentioned and those usable herein can include atoms belonging to the group III of the periodic table that provide p-type conductivity (hereinafter simply referred to as "group III atoms") or atoms belonging to the group V of the periodic table that provide n-type conductivity (hereinafter simply referred to as "group V atoms"). Specifically, the group III atoms can include B (boron), Al (aluminum), Ga (gallium), In (indium) and Tl (thallium), B and Ga being particularly preferred. The group V atoms can include P (phosphorus), As (arsenic), Sb (antimony), and Bi (bismuth), P and Sb being particularly preferred.

For the amount of the element for controlling the conductivity, it is preferably $1\times10^{-2}$ to $5\times10^5$ atomic ppm, more preferably $5\times10^{-1}$ to $1\times10^4$ atomic ppm, and, most preferably, 1 to $5\times10^3$ atomic ppm.

And as for the thickness of the IR layer, it is preferably 30 Å to 50 μm, more preferably 40 Å to 40 μm, and, most preferably, 50 Å to 30 μm.

Charge Injection Inhibition Layer 102

In the light receiving member for use in electrophotography of this invention, the charge injection inhibition layer 102 is formed of A—Si(H,X) containing the element for controlling the conductivity uniformly in the entire layer region or largely in the side of the substrate.

That layer may contain at least one kind selected nitrogen atoms, oxygen atoms and carbon atoms in the state of being distributed uniformly in the entire layer region or partial layer region but largely in the side of the substrate.

The charge injection inhibition layer 102 is disposed on the substrate 101, the IR layer 106, or the contact layer 107.

The halogen atom (X) to be contained in the charge injection inhibition layer include preferably F (fluorine), Cl (chlorine), Br (bromine), and I (iodine), F and Cl being particularly preferred.

The amount of hydrogen atoms (H), the amount of the hydrogen atoms (X) or the sum of the amounts for the hydrogen atoms and the halogen atoms (H+X) contained in the layer 102 is preferably 1 to 40 atomic %, and, most preferably, 5 to 30 atomic %.

As for the element for controlling the conductivity to be contained in the layer 102, the group III or group V atoms can be used likewise in the case of the above-mentioned IR layer.

Explanation will be made to the typical embodiments for distributing the group III atoms or group V atoms in the direction toward the layer thickness in the charge injection inhibition layer while referring to FIGS. 8 through 12.

In FIGS. 8 through 12, the abscissa represents the distribution concentration C of the group III atoms or group V atoms and the ordinate represents the thickness of the charge injection ihibition layer; and $t_B$ represents the extreme position of the layer adjacent to the substrate and $t_T$ represents the other extreme position of the layer which is away from the substrate.

The charge injection inhibition layer is formed from the $t_B$ side toward the $t_T$ side.

FIG. 2 shows the first typical example of the thicknesswise distribution of the group III atoms or group V atoms in the charge injection ihibition layer. In this example, the group III atoms or group V atoms are distributed such that the concentration C remains constant at a value $C_{12}$ in the range from position $t_B$ to position $t_4$, and the concentration C gradually and continuously decreases from $C_{13}$ in the range from position $t_4$ to position $t_T$, where the concentration of the group III atoms or group V atoms is $C_{14}$.

Figure 9:
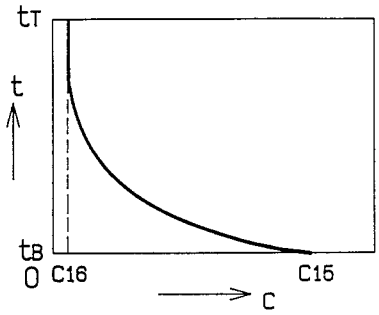

In the example shown in FIG. 9, the distribution concentration C of the group III atoms or group V atoms contained in the light receiving layer is such that concentration $C_{15}$ at position $t_B$ continuously decreases to concentration $C_{16}$ at position $t_T$.

Figure 10:
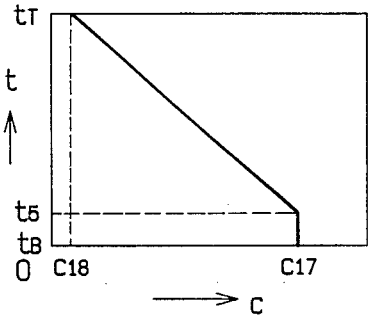

In the example shown in FIG. 10, the distribution concentration C of the group III atoms or group V atoms is such that concentration $C_{17}$ remains constant in the range from position $t_B$ to position $t_3$, and concentration $C_{17}$ linearly decreases to concentration $C_{18}$ in the range from position $t_5$ to position $t_T$.

Figure 11:
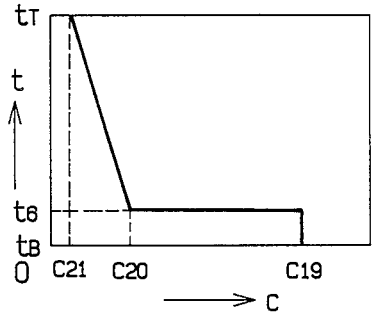

In the example shown in FIG. 11, the distribution concentration C of the group III atoms or group V atoms is such that concentration $C_{19}$ remains constant in the range from position $t_B$ and position $t_6$ and it linearly decreases from $C_{20}$ to $C_{21}$ in the range from position $t_6$ to position $t_T$.

Figure 12:
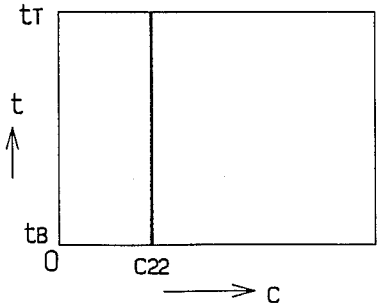

In the example shown in FIG. 12, the distribution concentration C of the group III atoms or group V atoms is such that concentration $C_{22}$ remains constant in the range from position $t_b$ and position $t_T$.

In the case where the group III atoms or group V atoms are contained in the charge injection inhibition layer in such way that the distribution concentration of the atoms in the direction of the layer thickness is higher in the layer region near the substrate, the thicknesswise distribution of the group III atoms or group V atoms is preferred to be made in the way that the maximum concentration of the group III atoms or group V atoms is controlled to be preferably greater than 50 atomic ppm, more preferably greater than 80 atomic ppm, and, most preferably, greater than $10^2$ atomic ppm.

For the amount of the group III atoms or group V atoms to be contained in the charge injection inhibition layer, it is properly determined according to desired requirements. However, it is preferably $3\times10$ to $5\times10^5$ atomic ppm, more preferably $5\times10$ to $1\times10^4$ atomic ppm, and, most preferably, $1\times10^2$ to $5\times10^3$ atomic ppm.

When at least one kind selected from nitrogen atoms, oxygen atoms and carbon atoms is incorporated in the charge injection inhibition layer, the bondability between the IR layer and the charge injection inhibition layer and the bondability between the charge injection inhibition layer and the photoconductive layer is effectively improved.

Explanation will be made to the typical embodiments for distributing at least one kind selected from nitrogen atom, oxygen atoms and carbon atoms in the direction toward the layer thickness in the charge injection inhibition layer, with reference to FIGS. 13 through 19.

In FIGS. 13 through 19, the abscissa represents the distribution concentration C of at least one kind selected from nitrogen atoms, oxygen atoms and carbon atoms, and the ordinate represents the thickness of the charge injection inhibition layer; and $t_B$ represents the extreme position of the layer adjacent to the substrate and $t_T$ represents the other extreme position of the layer which is away from the substrate. The charge injection inhibition layer is formed from the $t_B$ side toward the $t_T$ side.

Figure 13:
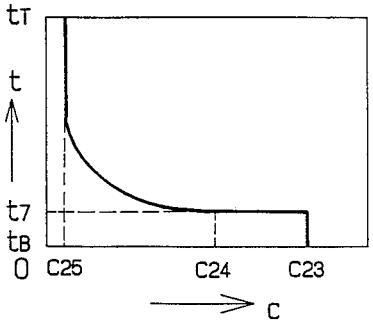
FIG. 13 through FIG. 19 are views illustrating the thicknesswise distribution of at least one kind selected from nitrogen atoms, oxygen atoms, and carbon atoms in the charge injection inhibition layer.

FIG. 13 shows the first typical example of the thicknesswise distribution of at least one kind selected from nitrogen atoms, oxygen atoms and carbon atoms in the charge injection inhibition layer. In this example, at least one kind selected from nitrogen atoms, oxygen atoms and carbon atoms are distributed such that the concentration C remains constant at a value $C_{23}$ in the range from position $t_B$ to position $t_7$, and the concentration C gradually and continuously decreases from $C_{24}$ in the range from position $t_7$ to position $t_T$, where the concentration of at least one kind selected from nitrogen atoms, oxygen atoms, and carbon atoms is $C_{25}$.

Figure 14:
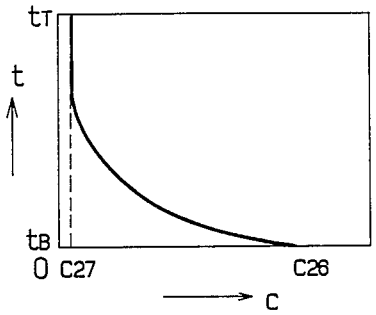

In the example shown in FIG. 14, the distribution concentration C of at least one kind selected from nitrogen atoms, oxygen atoms, and carbon atoms contained in the charge injection inhibition layer is such that concentration $C_{26}$ at position $t_B$ continuously decreases to concentration $C_{27}$ at position $t_T$.

Figure 15:
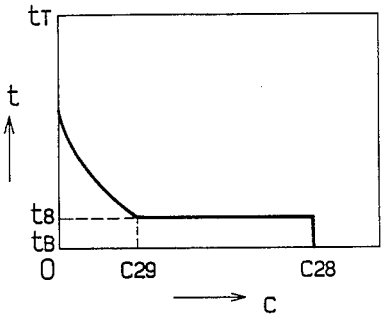

In the example shown in FIG. 15, the distribution concentration C of at least one kind selected from nitrogen atoms, oxygen atoms, and carbon atoms is such that concentration $C_{28}$ remains constant in the range from position $t_B$ and position $t_8$ and it gradually and continuously decreases from position $t_8$ and becomes substantially zero between $t_8$ and $t_T$.

Figure 16:
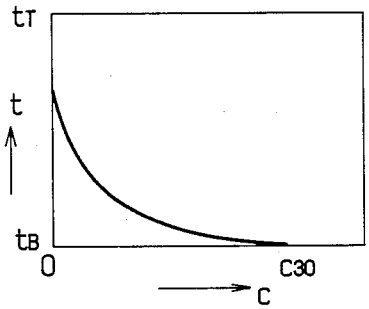

In the example shown in FIG. 16, the distribution concentration C of at least one kind selected from nitrogen atoms, oxygen atoms and carbon atoms is such that concentration $C_{30}$ gradually and continuously decreases from position $t_B$ and becomes substantially zero between $t_B$ and $t_T$.

Figure 17:
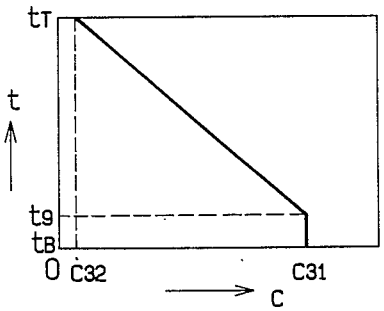

In the example shown in FIG. 17, the distribution concentration C of at least one kind selected from nitrogen atoms, oxygen atoms and carbon atoms is such that concentration $C_{31}$ remains constant in the range from position $t_B$ to position $t_9$, and concentration $C_9$ linearly decreases to concentration $C_{32}$ in the range from position $t_9$ to position $t_T$.

Figure 18:
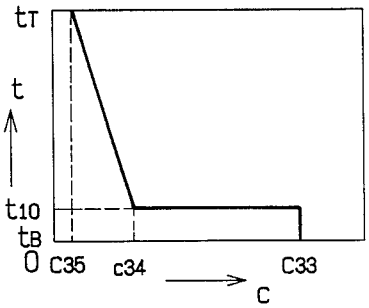

In the example shown in FIG. 18, the distribution concentration C of at least one kind selected from nitrogen atoms, oxygen atoms and carbon atoms is such that concentration $C_{33}$ remains constant in the range from position $t_B$ and position $t_{10}$ and it linearly decreases from $C_{34}$ to $C_{35}$ in the range from position $t_{10}$ to position $t_T$.

Figure 19:
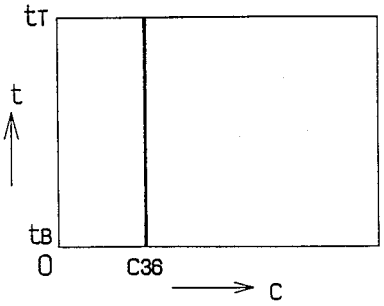
Figure 20:
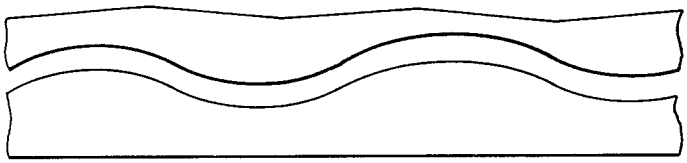
FIG. 20(A) through FIG. 20(C) are schematic views for examples of the shape at the surface of the substrate in the light receiving member for use in electrophotography according to this invention.
Figure 20:
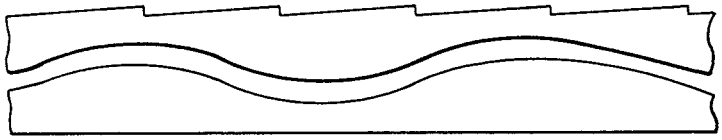
Figure 20:
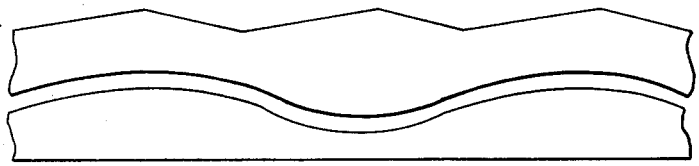

In the example shown in FIG. 19, the distribution concentration C of at least one kind selected from nitrogen atoms, oxygen atoms and carbon atoms is such that concentration $C_{36}$ remains constant in the range from position $t_B$ and position $t_T$.

In the case where at least one kind selected from nitrogen atoms, oxygen atoms and carbon atoms is contained in the charge injection inhibition layer such that the distribution concentration of these atoms in the layer is higher in the layer region near the substrate, the thicknesswise distribution of at least one kind selected from nitrogen atoms, oxygen atoms and carbon atoms is made in such way that the maximum concentration of at least one kind selected from nitrogen atoms, oxygen atoms and carbon atoms is controlled to be preferably greater than $5\times10^2$ atomic ppm, more preferably, greater than $8\times10^2$ atomic ppm, and, most preferably, greater than $1\times10^3$ atomic ppm.

As for the amount of at least one kind selected from nitrogen atoms, oxygen atoms and carbon atoms is properly determined according to desired requirements. However, it is preferably $1\times10^{-3}$ to 50 atomic %, more preferably, $2\times10^{-3}$ atomic % to 40 atomic %, and, most preferably, $3\times10^{-3}$ to 30 atomic %.

For the thickness of the charge injection inhibition layer, it is preferably $1\times10^{-2}$ to 10 μm, more preferably, $5\times10^{-2}$ to 8 μm, and, most preferably, $1\times10^{-1}$ to 5 μm in the viewpoints of bringing about electrophotographic characteristics and economical effects.

Photoconductive Layer 103 (or 2103)

The photoconductive layer 103 (or 2103) is disposed on the substrate 101 (or 2102) as shown in FIG. 1 (or FIG. 21).

The photoconductive layer is formed of an a—Si(H,X) material or an a—Si(H,X)(O,N) material.

The photoconductive layer has the semiconductor characteristics as under mentioned and shows a photoconductivity against irradiated light.

(i) p-type semiconductor characteristics: containing an acceptor only or both the acceptor and a donor in which the relative content of the acceptor is higher;

(ii) p-type semiconductor characteristics: the content of the acceptor (Na) is lower or the relative content of the acceptor is lower in the case (i);

(iii) n-type semiconductor characteristics: containing a donor only or both the donor and an acceptor in which the relative content of the donor is higher;

(iv) n-type semiconductor characteristics: the content of donor (Nd) is lower or the relative content of the acceptor is lower in the case (iii); and (v) i-type semiconductor characteristics: $Na\simeq Nd\simeq 0$ or $Na\simeq Nd$.

In order for the photoconductive layer to be a desirable type selected from the above-mentioned types (i) to (v), it can be carried out by doping a p-type impurity, an n-type impurity or both the impurity with the photoconductive layer to be formed during its forming process while controlling the amount of such impurity.

As the element to be such impurity to be contained in the photoconductive layer, the so-called impurities in the field of the semiconductor can be mentioned, and those usable herein can include atoms belonging to the group III or the periodical table that provide p-type conductivity (hereinafter simply referred to as "group III atom") or atoms belonging to the group V of the periodical table that provide n-type conductivity (hereinafter simply referred to as "group V atom"). Specifically, the group III atoms can include B (boron), Al (aluminum), Ga (gallium), In (indium) and Tl (thallium). The group V atoms can include, for example, P (phosphorus), As (arsenic), Sb (antimony) and Bi (bismuth). Among these elements, B, Ga, P and As are particularly preferred.

The amount of the group III atoms or the group V atoms to be contained in the photoconductive layer is preferably $1\times10^3$ to $3\times10$ atomic ppm, more preferably, $5\times10^3$ to $1\times10^2$ atomic ppm, and, most preferably, $1\times10^2$ to 50 atomic ppm.

In the photoconductive layer, oxygen atoms or/and nitrogen atoms can be incorporated in the range as long as the characteristics required for that layer is not hindered.

In the case of incorporating oxygen atoms or/and nitrogen atoms in the entire layer region of the photoconductive layer, its dark resistance and close bondability with the substrate are improved.

The amount of oxygen atoms or/and nitrogen atoms to be incorporated in the photoconductive layer is desired to be relatively small not to deteriorate its photoconductivity.

In the case of incorporating nitrogen atoms in the photoconductive layer, its photosensitivity in addition to the above advantages may be improved when nitrogen atoms are contained together with boron atoms therein.

The amount of one kind selected from nitrogen atoms (N), and oxygen atoms (O) or the sum of the amounts for two kinds of these atoms to be contained in the photoconductive layer is preferably $5\times10^{-4}$ to 30 atomic %, more preferably, $1\times10^{-2}$ to 20 atomic %, and, most preferably, $2\times10^{-2}$ to 15 atomic %.

The amount of the hydrogen atoms (H), the amount of the halogen atoms (H) or the sum of the amounts for the hydrogen atoms and the halogen atoms (H+X) to be incorporated in the photoconductive layer is preferably 1 to 40 atomic %, more preferably, 5 to 30 atomic %.

The halogen atom (X) includes, specifically, fluorine, chlorine, bromine and iodine. And among these halogen atoms, fluorine and chlorine and particularly preferred.

The thickness of the photoconductive layer is an important factor in order for the photocarriers generated by the irradiation of light having desired spectrum characteristics to be effectively transported, and it is appropriately determined depending upon the desired purpose.

It is, however, also necessary that the layer thickness be determined in view of relative and organic relationships in accordance with the amounts of the halogen atoms and hydrogen atoms contained in the layer or the characteristics required in the relationship with the thickness of other layer. Further, it should be determined also in economical point of view such as productivity or mass productivity. In view of the above, the thickness of the photoconductive layer is preferably 1 to 100 μm, more preferably, 1 to 80 μm, and, most preferably, 2 to 50 μm.

Surface Layer 104 (or 2104)

The surface layer 104 (or 2104) having the free surface 105 (or 2105) is disposed on the photoconductive layer 103 (or 2103) to attain the objects chiefly of moisture resistance, deterioration resistance upon repeating use, electrical voltage withstanding property, use environmental characteristics and durability for the light receiving member for use in electrophotography according to this invention.

The surface layer is formed of the amorphous material containing silicon atoms as the constituent element which are also contained in the layer constituent amorphous material for the photoconductive layer, so that the chemical stability at the interface between the two layers is sufficiently secured.

Typically, the surface layer is formed of an amorphous material containing silicon atoms, carbon atoms, and hydrogen atoms (hereinafter referred to as "A—$(Si_xC_{1-x})_yH_{1-y}$", $x>0$ and $y<1$).

It is necessary for the surface layer for the light receiving member for use in electrophotography according to this invention to be carefully formed in order for that layer to bring about the characteristics as required.

That is, a material containing silicon atoms (Si), carbon atoms (C) and hydrogen atoms (H) as the constituent elements is structurally extended from a crystalline state to an amorphous state which exhibits electrophysically properties from conductiveness to semiconductiveness and insulativeness, and other properties from photoconductiveness to in photoconductiveness according to the kind of a material.

Therefore, in the formation of the surface layer, appropriate layer forming conditions are required to be strictly chosen under which a desired surface layer composed of A—$Si_xC_{1-x}$ having the characteristics as required may be effectively formed.

For instance, in the case of disposing the surface layer with aiming chiefly at improvements in its electrical voltage withstanding property, the surface layer composed of A—$(Si_xC_{1-y})_y$:$H_{1-y}$ is so formed that it exhibits a significant electrical insulative behavior in use environment.

In the case of disposing the surface layer with aiming at improvements in repeating use characteristics and use environmental characteristics, the surface layer composed of A—$Si_xC_{1-x}$ is so formed that it has certain sensitivity to irradiated light although the electrical insulative property should be somewhat decreased.

The amount of carbon atoms and the amount of hydrogen atoms respectively to be contained in the surface layer of the light receiving member for use in electrophotography according to this invention are important factors as well as the surface layer forming conditions in order to make the surface layer accompanied with desired characteristics to attain the objects of this invention.

The amount of the carbon atoms (C) to be incorporated in the surface layer is preferably $1\times10^{-3}$ to 90 atomic %, and, most preferably, 10 to 80 atomic % respectively to the sum of the amount of the silicon atoms and the amount of the carbon atoms.

The amount of the hydrogen atoms to be incorporated in the surface layer is preferably 41 to 70 atomic %, more preferably 41 to 65 atomic %, and, most preferably, 45 to 60 atomic % respectively to the sum of the amount of all the constituent atoms to be incorporated in the surface layer.

As long as the amount of the hydrogen atoms to be incorporated in the surface layer lies in the above-mentioned range, any of the resulting light receiving members for use in electrophotography becomes rich in significantly practically applicable characteristics and excels beyond the conventional light receiving members for use in electrophotography in every viewpoint.

That is, for the conventional light receiving member for use in electrophotography, that is known that when there exist certain defects within the surface layer composed of A—$(Si_xC_{1-x})_y:H_{1-y}$ (due to mainly dangling bonds of silicon atoms and those of carbon atoms) they give undesirable influences to the electrophotographic characteristics.

For instance, because of such defects there are often invited deterioration in the electrification characteristics due to charge injection from the side of the free surface, changes in the electrification characteristics due to alterations in the surface structure under certain use environment, for example, high moisture atmosphere, and appearance of residual images upon repeating use due to that an electric charge is injected into the surface layer from the photoconductive layer at the time of corona discharge or at the time of light irradiation to thereby make the electric charge trapped for the defects within the surface layer.

However, the above defects being present in the surface layer of the conventional light receiving member for use in electrophotography which invite various problems as mentioned above can be largely eliminated by controlling the amount of the hydrogen atoms to be incorporated in the surface layer to be more than 41 atomic %, and as a result, the foregoing problems can be almost resolved. In addition, the resulting light receiving member for use in electrophotography have extremely improved advantages especially in the electric characteristics and the repeating usability at high speed in comparison with the conventional light receiving member for use in electrophotography.

And, the maximum amount of the hydrogen atoms to be incorporated in the surface layer is necessary to be 70 atomic %. That is, when the amount of the hydrogen atoms exceeds 70 atomic %, the hardness of the surface layer is undesirably decreased so that the resulting light receiving member becomes such that can not be repeatedly used for a long period of time.

In this connection, it is an essential factor for the light receiving member for use in electrophotography of this invention that the surface layer contains the amount of the hydrogen atoms ranging in the above-mentioned range.

For the incorporation of the hydrogen atoms in said particular amount in the surface layer, it can be carried out by appropriately controlling the related conditions such as the flow rate of a starting gaseous substance, the temperature of a substrate, discharging power and the gas pressure.

Specifically, in the case where the surface layer is formed of A—$(Si_xC_{1-x})_y:H_{1-y}$, the "x" is preferably 0.1 to 0.99999, more preferably 0.1 to 0.99, and, most preferably, 0.15 to 0.9. And the "y" is preferably 0.3 to 0.59, more preferably 0.35 to 0.59, and, most preferably, 0.4 to 0.55.

The thickness of the surface layer in the light receiving member according to this invention is appropriately determined depending upon the desired purpose.

It is, however, also necessary that the layer thickness be determined in view of relative and organic relationships in accordance with the amounts of the halogen atoms, hydrogen atoms and other kind atoms contained in the layer or the characteristics required in the relationship with the thickness of other layer. Further, it should be determined also in economical point of view such as productivity or mass productivity. In view of the above factors, the thickness of the surface layer is preferably 0.003 to 30 μm, more preferably, 0.004 to 20 μm, and, most preferably, 0.005 to 10 μm.

By the way, the thickness of the light receiving layer 100 constituted by the photoconductive layer 103 (or 2103 in FIG. 21) and the surface layer 104 (or 2104 in FIG. 21) in the light receiving member for use in electrophotography according to this invention is appropriately determined depending upon the desired purpose.

In any case, said thickness is appropriately determined in view of relative and organic relationships between the thickness of the photoconductive layer and that of the surface layer so that the various desired characteristics for each of the photoconductive layer and the surface layer in the light receiving member for use in electrophotography can be sufficiently brought about upon the use to effectively attain the foregoing objects of this invention.

And, it is preferred that the thicknesses of the photoconductive layer and the surface layer be determined so that the ratio of the former versus the latter lies in the range of some hundred times to some thousand times.

Specifically, the thickness of the light receiving layer 100 is preferably 3 to 100 μm, more preferably 5 to 70 μm, and, most preferably, 5 to 50 μm.

Preparation of Layers

The method of forming the light receiving layer 100 of the light receiving member will be now explained.

Each of the layers to be constitue the light receiving layer of the light receiving member of this invention is properly prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the light receiving members having desired properties are relatively easy, and hydrogen atoms, halogen atoms and other atoms can be introduced easily together with silicon atoms. The glow discharging method and the sputtering method may be used together in one identical system.

Preparation of Photoconductive Layer, Charge Injection Inhibition Layer, and Contact Layer Basically, when a layer constituted with A—Si(H,X) is formed, for ecample, by the glow discharging method, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of A—Si(H,X) is formed on the surface of a substrate placed in the deposition chamber.

The gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

Further, various halogen compounds can be mentioned as the gaseous starting material for introducing the halogen atoms, and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$. The use of the gaseous or gasifiable silicon halide as described above is particularly advantageous since the layer constituted with halogen atom-containing A—Si:H can be formed with no additional use of the gaseous starting silicon hydride material for supplying Si.

In the case of forming a layer constituted with an amorphous material containing halogen atoms, typically, a mixture of a gaseous silicon halide substance as the starting material for supplying Si and a gas such as Ar, $H_2$ and He is introduced into the deposition chamber having a substrate in a predetermined mixing ratio and at a predetermined gas flow rate, and the thus introduced gases are exposed to the action of glow discharge to thereby cause a gas plasma resulting in forming said layer on the substrate.

And, for incorporating hydrogen atoms in said layer, an appropriate gaseous starting material for supplying hydrogen atoms can be additionally used.

Now, the gaseous starting material usable for supplying hydrogen atoms can include those gaseous or gasifiable materials, for example, hydrogen gas ($H_2$), halides such as HF, HCl, HBr, and HI, silicon hydrides such as $SiH_4$, $Si_2H_6$, $Si_3H_8$, and $Si_4H_{10}$, or halogen-substituted silicon hydrides such as $SiH_2F_2$, $SiH_2I_2$, $SiH_2Cl_2$, $SiHCl_3$, $SiH_2Br_2$, and $SiHBr_3$. The use of these gaseous starting material is advantageous since the content of the hydrogen atoms (H), which are extremely effective in view of the control for the electrical or photoelectronic properties, can be controlled with ease. Then, the use of the hydrogen halide or the halogen-substituted silicon hydride as described above is particularly advantageous since the hydrogen atoms (H) are also introduced together with the introduction of the halogen atoms.

The amount of the hydrogen atoms (H) and/or the amount of the halogen atoms (X) to be contained in a layer are adjusted properly by controlling related conditions, for example, the temperature of a substrate, the amount of a gaseous starting material copable of supplying the hydrogen atoms or the halogen atoms into the deposition chamber and the electric discharging power.

In the case of forming a layer composed of A—Si(H,X) by the reactive sputtering process, the layer is formed on the substrate by using an Si target and sputtering the Si target in a plasma atmosphere.

To form said layer by the ion-plating process, the vapor of silicon is allowed to pass through a desired gas plasma atmosphere. The silicon vapor is produced by heating polycrystal silicon or single crystal silicon held in a boat. The heating is accomplished by resistance heating or electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate halogen atoms includes the above-mentioned halogen-containing silicon compounds.

For example, in the case of the reactive sputtering process, the layer composed of A—Si(H,X) is formed on the substrate by using an Si target and by introducing a halogen-atom introducing gas and $H_2$ gas, if necessary, together with an inert gas such as He or Ar into the deposition chamber to thereby form a plasma atmosphere and then sputtering the Si target.

In order to form a layer constituted with an amorphous material composed of a—Si(H,X) further incorporated with the group III atoms or the group V atoms using a glow discharging, sputtering or ion plating process, the starting material for introducing the group III or group V atoms is used together with the starting material for forming a—Si(H,X) upon forming the a—Si(H,X) layer while controlling the amount of them in the layer to be formed.

For instance, in the case of forming a layer composed of A—Si(H,X) containing the group III or group V atoms, namely A—SiM(H,X) in which M stands for the group III or group V atoms, by using the glow discharging, the starting gases material for forming the a—SiM(H,X) are introduced into a deposition chamber in which a substrate being placed, optionally being mixed with an inert gas such as Ar or He in a predetermined mixing ratio, and the thus introduced gases are exposed to the action of glow discharge to thereby cause a gas plasma resulting in forming a layer composed of a—SiM(H,X) on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically to, the phosphor (phosphorous) atom introducing materials, they can include, for example, phosphor hydrides such as $PH_3$ and $P_2H_6$ and phosphor halide such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned to as the effective starting material for introducing the group V atoms.

In order to form a layer containing nitrogen atoms using the glow discharging process, the starting material for introducing nitrogen atoms is added to the material selected as required from the starting materials for forming said layer as described above. As the starting material for introducing nitrogen atoms, most of gaseous or gasifiable materials which contain at least nitrogen atoms as the constituent atoms can be used.

For instance, it is possible to use a mixture of a gaseous starting material containing silicon atoms (Si) as the constituent atoms, a gaseous starting material containing nitrogen atoms (N) as the constituent atoms and, optionally, a gaseous starting material containing hydrogen atoms (H) and/or halogen atoms (X) as the constituent atoms in a desired mixing ratio, or a mixture of a starting gaseous material containing silicon atoms (Si) as the constituent atoms and a gaseous starting material containing nitrogen atoms (N) and hydrogen atoms (H) as the constituent atoms also in a desired mixing ratio.

Alternatively, it is also possible to use a mixture of a gaseous starting material containing nitrogen atoms (N) as the constituent atoms and a gaseous starting material containing silicon atoms (Si) and hydrogen atoms (H) as the constituent atoms.

The starting material that can be used effectively as the gaseous starting material for introducing the nitrogen atoms (N) used upon forming the layer containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$), hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

The layer containing nitrogen atoms may be formed through the sputtering process by using a single crystal or polycrystalline Si wafer of $Si_3N_4$ wafer or a wafer containing Si and $Si_3N_4$ in admixture as a target and sputtering them in various gas atmospheres.

In the case of using an Si wafer as a target, for instance, a gaseous starting material for introducing nitrogen atoms and, as required, hydrogen atoms and/or halogen atoms is diluted optionally with a dilution gas, and introduced into a sputtering deposition chamber to form gas plasmas with these gases and the Si wafer is sputtered.

Alternatively, Si and $Si_3H_4$ may be used as individual targets or as a single target comprising Si and $Si_3N_4$ in admixture and then sputtered in the atmosphere of a dilution gas or in a gaseous atmosphere containing at least hydrogen atoms (H) and/or halogen atoms (X) as the constituent atoms as for the sputtering gas. As the gaseous starting material for introducing nitrogen atoms, those gaseous starting materials for introducing the nitrogen atoms described previously shown in the example of the glow discharging can be used as the effective gas also in the case of the sputtering.

In order to form a layer containing carbon atoms using the glow discharging process, the gaseous starting material for introducing carbon atoms is added to the material selected as required from the starting materials for forming said layer as described above. As the starting material for introducing carbon atoms, gaseous or gasifiable materials containing carbon atoms as the constituent atoms can be used.

And it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) and/or halogen atoms (X) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si) in the glow discharging process as described above.

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In the case of forming a layer containing carbon atoms (C) by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, a gaseous starting material for introducing carbon atoms (C) is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

In order to form a layer containing oxygen atoms using the glow discharging process, the gaseous starting material for introducing the oxygen atoms is added to the material selected as required from the starting materials for forming said layer as described above.

As the starting material for introducing oxygen atoms, most of those gaseous or gasifiable materials which contain at least oxygen atoms as the constituent atoms.

For instance, it is possible to use a mixture of a gaseous starting material containing silicon atoms (Si) as the constituent atoms, a gaseous starting material containing oxygen atoms (O) as the constituent atoms and, as required, a gaseous starting material containing hydrogen atoms (H) and/or halogen atoms (X) as the constituent atoms in a desired mixing ratio, a mixture of gaseous starting material containing silicon atoms (Si) as the constituent atoms and a gaseous starting material containing oxygen atoms (O) and hydrogen atoms (H) as the constituent atoms in a desired mixing ratio, or a mixture of gaseous starting material containing silicon atoms (Si) as the constituent atoms and a gaseous starting material containing silicon atoms (Si) oxygen atoms (O) and hydrogen atoms (H) as the constituent atoms.

Further, it is also possible to use a mixture of a gaseous starting material containing silicon atoms (Si) and hydrogen atoms (H) as the constituent atoms and a gaseous starting material containing oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

In the case of forming a layer containing oxygen atoms by way of the sputtering process, it may be carried out by sputtering a single crystal or polycrystalline Si wafer or $SiO_2$ wafer, or a wafer containing Si and $SiO_2$ in admixture is used as a target and sputtered them in various gas atmospheres.

For instance, in the case of using the Si wafer as the target, a gaseous starting material for introducing oxygen atoms and, optionally, hydrogen atoms and/or halogen atoms is diluted as required with a dilution gas, introduced into a sputtering deposition chamber, gas plasmas with these gases are formed and the Si wafer is sputtered.

Alternatively, sputtering may be carried out in the atmosphere of a dilution gas or in a gas atmosphere containing at least hydrogen atoms (H) and/or halogen atoms (X) as constituent atoms as a sputtering gas by using individually Si and $SiO_2$ targets or a single Si and $SiO_2$ mixed target. As the gaseous starting material for introducing the oxygen atoms, the gaseous starting material for introducing the oxygen atoms shown in the examples for the glow discharging process as described above can be used as the effective gas also in the sputtering.

For the formation of a photoconductive layer a charge injection inhibition layer, or a contact layer of the light receiving member of this invention by means of the glow discharging process, sputtering process or ion plating process, the content of the oxygen atoms, carbon atoms, nitrogen atoms or the group III or V atoms to be introduced into a—Si(H,X) is controlled by controlling the gas flow rate and the ratio of the gas flow rate of the starting materials entered in the deposition chamber.

The condition upon forming these layers, for example, the temperature of the substrate, the gas pressure in the deposition chamber and the electric discharging power are important factors for obtaining a desirable light receiving member having desired properties and they are properly selected while considering the functions of the layer to be formed. Further, since these layer forming conditions may be varied depending on the kind and the amount of each of the atoms contained in these layers, the conditions have to be determined also taking the kind or the amount of the atoms to be contained into consideration.

Specifically, the temperature of the support is preferably from 50° to 350° C. and, most preferably, from 100° to 250° C. The gas pressure in the deposition chamber is preferably from 0.01 to 1 Torr and, most preferably, from 0.1 to 0.5 Torr. Further, the electrical discharging power is preferably from 0.005 to 50 W/cm$^2$, more preferably, from 0.01 to 30 W/cm$^2$ and, most preferably, from 0.01 to 20 W/cm$^2$.

However, the actual conditions for forming these layers such as the temperature of substrate, discharging power and the gas pressure in the deposition chamber can not usually be determined with ease independent of each other. Accordingly, the conditions optimal for the layer formation are desirably determined based on relative and organic relationships for forming these amorphous material layers having desired properties.

Preparation of IR Layer

Basically, when an IR layer constituted with A—SiGe (H,X) is formed, for example, by the glow discharge method, gaseous starting material capable of supplying silicon atoms (Si) is introduced together with gaseous starting material capable of supplying germanium atoms (Ge), and if ncessary gaseous starting material for introducing hydrogen atoms (H) and/or halogen atoms (X) into a deposition chamber the insdie pressure of which can be reduced, glow discharge is generated in the deposition chamber, and a layer composed of A—SiGe(H,X) is formed on the surface of the substrate placed in the deposition chamber. In the case of forming the IR layer composed of A—Si(H,X) containing germanium atoms at uneven distribution concentration in the direction of the layer thickness, the layer composed of A—SiGe(H,X) is formed by controlling the distributing concentration of germanium atoms along with a properly variation coefficient curve.

To form the layer of A—SiGe(H,X) by the sputtering process, a single target composed of silicon, or two targets (the said target and a target composed of germanium), further a single target composed of silicon and germanium is subjected to sputtering in atmosphere of an inert gas such as He or Ar, and if necessary gaseous starting material capable of supplying germanium atoms diluted with an inert gas such as He or Ar and/or gaseous starting material for introducing hydrogen atoms (H) and/or halogen atoms (H) are introduced into the sputtering deposition chamber thereby forming a plasma atmosphere with the gas. In the case of forming the IR layer formed of A—Si(H,X) containing germanium atoms at uneven distribution concentration, the target is subjected to sputtering by controlling the gas flow rate of gaseous starting material capable of supplying germanium atoms along with a properly variation coefficient curve.

To form the layer of A—SiGe(H,X) by the ion-plating process, the layer can be formed in the same method except that polycrystal silicon, or single crystal silicon and polycrystal germanium or single crystal silicon are held as a vapor source on a boat, and the vapor source is evaporated by heating. The heating is accomplished by resistance heating method or electron beam method (E.B. method).

In either case, the gaseous starting material for supplying Si can include gaseous or gasifiable silicon hydrides (silanes) such as $SiH_4$, $Si_2H_6$, $Si_3H_8$, $Si_4H_{10}$, etc., $SiH_4$ and $SiH_6$ being particularly preferred in view of the easy layer forming work and the good efficiency for the supply of Si.

The gaseous starting material for supplying Ge can include gaseous or gasifiable germanium hydrides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, etc., $GeH_4$, $Ge_2H_6$, and $Ge_3H_8$ being particularly preferred in view of the easy layer forming work and the good efficiency for the supply of Ge.

Further, various halogen compounds can be mentioned as the gaseous starting material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2H_6$, $SiCl_4$, and $SiBr_4$. The use of the gaseous or gasifiable silicon halide as described above is particularly advantageous since the IR layer constituted with halogen atom-containing a—SiGe can be formed with no additional use of the gaseous starting material for supplying Si with the gaseous starting material for supplying Ge.

Basically, in the case of forming an IR layer constituted with an amorphous material containing halogen atoms by the glow discharge method, for example, a mixture of a gaseous silicon halide substance as the starting material for supplying Si, a gaseous germanium hydride substance as the starting material for supplying Ge, and a gas such as Ar, He and He is introduced into the deposition chamber having a substrate in a predetermined mixing ratio and at a predetermined gas flow rate, and the thus introduced gases are exposed to the action of glow discharge to thereby cause a gas plasma resulting in forming said layer on the substrate. And, for incorporating hydrogen atoms in said layer, an appropriate gaseous starting material for supplying hydrogen atoms can be addtionally used.

In the case of forming the layer containing halogen atoms by either the sputtering process or the ion-plating process, the above-mentioned gaseous halides or halogen-containing silicon compounds is introduced into the deposition chamber in which a plasma atmosphere of the gas is produced.

And, in the case of forming the layer containing hydrogen atoms by the sputtering process, gaseous starting material for introducing hydrogen atoms such as $H_2$, said silane or/and germanium hydride is introducted into the deposition chamber in which a plasma atmosphere of the gas is produced.

The gaseous starting material includes the above-mentioned halides or halogen-containing silicon compounds.

Other examples of the feed gas include hydrogen halides such as HF, HCl, HBr, and HI; halogen-substituted silanes such as $SiH_2F_2$, $SiH_2I_2$, $SiH_2Cl_2$, $SiHCl_3$, $SiH_2Br_2$, and $SiHBr_3$; germanium hydride halide such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$; and germanium halides such as $GeF_4$, $GeCl_4$, $GeBr_4$, $GeI_4$, $GeF_2$, $GeCl_2$, $GeBr_2$, and $GeI_2$. They are in the gaseous form or gasifiable substances. The use of the gaseous or gasifiable hydrogen-containing halides is particularly advantageous since, at the time of forming the IR layer, the hydrogen atoms, which are extremely effective in view of controlling the electrical or photoelectrographic properties, can be introduced into the IR layer together with halogen atoms.

The structural introduction of hydrogen atom into the IR layer can be carried out by introducing, in addition to these gaseous starting materials, $H_2$ or silicon hydrides such as $SiH_4$, $SiH_6$, $Si_3H_6$, $Si_4H_{10}$, etc. into the deposition chamber together with a gaseous or gasifiable germanium containing material for supplying Ge such as germanium hydrides, for example, $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$ or $Ge_9H_{20}$, and producing a plamsa atmosphere with these gases therein.

The amount of the hydrogen atoms (H) and/or the amount of the halogen atoms (X) to be contained in the IR layer are adjusted properly by controlling related conditions, for example, the temperature of a substrate, the amount of a gaseous starting material capable of supplying the hydrogen atoms or the halogen atoms into the deposition chamber and the electric discharging power.

In order to form a layer constituted with an amorphous material composed of A—SiGe(H,X) further incorporated with the group III atoms or the group V atoms using a glow discharging, sputtering or ion plating process, the starting material for introducing the group III or group V atoms is used together with the starting material for forming A—SiGe(H,X) upon forming the A—SiGe(H,X) layer while controlling the amount of them in the layer to be formed.

For instance, in the case of forming a layer composed of A—SiGe(H,X) containing the group III or group V atoms, namely A—SiGeM(H,X) in which M stands for the group III or group V atoms, by using the glow discharging, the starting gases material for forming the A—SiGeM(H,X) are introduced into a deposition chamber in which a substrate being placed, optionally being mixed with an inert gas such as Ar or He in a predetermined mixing ratio, and the thus introduced gases are exposed to the action of glow discharge to thereby cause a gas plasma resulting in forming a layer composed of A—SiGeM(H,X) on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_5H_{12}$ and $B_5H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

The IR layer constituted by SiGe(H,X) may be formed from an amorphous material which further contains the group III atoms or group V atoms, nitrogen atoms, oxygen atoms, or carbon atoms may be formed by the glow-discharge process, sputtering process, or ion-plating process. In this case, the above-mentioned starting material for A—SiGe (H,X) is used in combination with the starting materials to introduce the group III atoms or group V atoms, or at least one kind selected from nitrogen atoms, oxygen atoms and carbon atoms, (hereinafter referred to as "atoms (N,O,C)"). The supply of the starting materials should be properly controlled so that the layer contains a desired amount of the necessary atoms.

If, for example, the layer is to be formed by the glow-discharge process from A—SiGe(H,X) containing atoms (N,O,C), the starting material to form the layer of A—SiGe(H,X) should be combined with the starting material used to introduce atoms (N,O,C). The supply of these starting materials should be properly controlled so that the layer contains a desired amount of the necessary atoms.

The starting material to introduce the atoms (N,O,C) may be many gaseous substance or gasifiable substance composed of any of oxygen, carbon, and nitrogen. Examples of the starting materials used to introduce oxygen atoms (O) include oxygen ($O_2$), ozone ($O_3$), nitrogen dioxide ($NO_2$), nitrous oxide ($N_2O$), dinitrogen trioxide ($N_2O_3$), dinitrogen tetraoxide ($N_2O_4$), dinitrogen pentoxide ($N_2O_5$), and nitrogen trioxide ($NO_3$). Additional examples include lower siloxanes such as disiloxane ($H_3SiOSiH_3$) and trisiloxane ($H_3SiOSiH_2OSiH_3$) which are composed of silicon atoms (Si), oxygen atoms (O), and hydrogen atoms (H). Examples of the starting materials used to introduce carbon atoms include saturated hydrocarbons having 1 to 5 carbon atoms such as methane ($CH_4$), ethane ($C_2H_6$), propane ($C_3H_8$), n-butane (n-$C_4H_{10}$), and pentane ($C_5H_{12}$); ethylenic hydrocarbons having 2 to 5 carbon atoms such as ethylene ($C_2H_4$), propylene ($C_3H_6$), butene-1 ($C_4H_8$), butene-2 ($C_4H_8$), isobutylene ($C_4H_8$), and pentene ($C_5H_{10}$); and acetylenic hydrocarbons having 2 to 4 carbon atoms such as acetylene ($C_2H_2$), methyl acetylene ($C_3H_4$), and butine ($C_4H_6$). Examples of the starting materials used to introduce nitrogen atoms include nitrogen ($N_2$), ammonium ($NH_3$), hydrazine ($H_2NNH_2$), hydrogen azide ($HN_3$), ammonium azide ($NH_4N_3$), nitrogen trifluoride ($F_3N$), and nitrogen tetrafluoride ($F_4N$).

For instance, in the case of forming an IR layer constituted with A—SiGe(H,X) containing the group III atoms or group V atoms by using the glow discharging, sputtering, or ion-plating process, the starting material for introducing the group III or group V atoms are used together with the starting material for forming A—SiGe(H,X) upon forming the layer constituted with A—SiGe(H,X) as described above and they are incorporated while controlling the amount of them into the layer to be formed.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$, and $B_6H_{14}$ and boron halides such as $BF_3$, $BCl_3$, and $BBr_3$. In addition, $AlCl_3$, $CaCl_3$, $Ga(CH_3)_2$, $InCl_3$, $TiCl_3$, and the like can also be mentioned.

Referring to the starting material for introducing the group V atoms and, specifically, to the phosphorus atoms introducing materials, they can include, for example, phosphorus hydrides such as $PH_3$ and $P_2H_6$ and phosphorus halides such as $PH_4I$, $PF_3$, $PF_5$, $PCl_3$, $PCl_5$, $PBr_3$, $PBr_5$, and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $BiCl_3$, and $BiBr_3$ can also be mentioned to as the effective starting material for introducing the group V atoms.

As mentioned above, the light receiving layer of the light receiving member of this invention is produced by the glow discharge process or sputtering process. The amount of germanium atoms; the group III atoms or group V atoms; oxygen atoms, carbon atoms, or nitrogen atoms; and hydrogen atoms and/or halogen atoms in the IR layer is controlled by regulating the flow rate of the starting materials entering the deposition chamber.

The conditions upon forming the IR layer of the light receiving member of the invention, for example, the temperature of the support, the gas pressure in the deposition chamber, and the electric discharging power are important factors for obtaining the light receiving member having desired properties and they are properly selected while considering the function of the layer to be made. Further, since these layer forming conditions may be varied depending on the kind and the amount of each of the atoms contained in the IR layer, the conditions have to be determined also taking the kind or the amount of the atoms to be contained into consideration.

In the case where the layer of A—SiGe(H,X) is to be formed or the layer of A—SiGe(H,X) containing oxygen atoms, carbon atoms, nitrogen atoms, and the group III atoms or group V atoms, is to be formed, the temperature of the support is usually from 50° to 350° C., preferably, from 50° to 300° C., most suitably 100° to 300° C.; the gas pressure in the deposition chamber is usually from 0.01 to 5 Torr, preferably, from 0.001 to 3 Torr, most suitably from 0.1 to 1 Torr; and the electrical discharging power is usually from 0.005 to 50 W/cm$^2$, preferably, from 0.01 to 30 W/cm$^2$, most preferably, from 0.01 to 20 W/cm$^2$.

However, the actual conditions for forming the layer such as temperature of the support, discharging power and the gas pressure in the deposition chamber cannot usually be determined with ease independent of each other. Accordingly, the conditions optimal to the layer formation are desirably determined based on relative and organic relationships for forming the amorphous material layer having desired properties.

By the way, it is necessary that the foregoing various conditions are kept constant upon forming the IR layer for unifying the distribution state of germanium atoms, oxygen atoms, carbon atoms, nitrogen atoms, the group III atoms or group V atoms, or hydrogen atoms and/or halogen atoms to be contained in the light receiving layer according t this invention.

Further, in the case of forming the IR layer comprising germanium atoms, oxygen atoms, carbon atoms, nitrogen atoms, or the group III atoms or group V atoms at a desired distribution state in the direction of the layer thickness by varying their distribution concentration in the direction of the layer thickess upon forming the IR layer in this inventtion, the layer is formed, for example, in the case of the glow discharging process, by properly varying the gas flow rate of gaseous starting material for introducing germanium atoms, oxygen atoms, carbon atoms, nitrogen atoms, or the group III atoms or group V atoms upon introducing into the deposition chamber in accordance with a desired variation coefficient while maintaining other conditions constant. Then, the gas flow rate may be varied, specifically, by gradually changing the opening degree of a predetermined needle valve disposed to the midway of the gas flow system, for example, manually or any of other means usually employed such as in externally driving motor. In this case, the variation of the flow rate may not necessarily be linear but a desired content curve may be obtained, for example, by controlling the flow rate along with a previously designed variation coefficient curve by using a microcomputer or the like.

Further, in the case of forming the IR layer by means of the sputtering process, a desired distributed state of the germanium atoms, oxygen atoms, carbon atoms, nitrogen atoms, or the group III atoms or group V atoms in the direction of the layer thickness may be formed with the distribution density being varied in the direction of the layer thickness by using gaseous starting material for introducing the germanium atoms, oxygen atoms, carbon atoms, nitrogen atoms, or the group III atoms or group V atoms and varying the gas flow rate upon introducing these gases into the deposition chamber in accordance with a desired variation coefficient in the same amnner as the case of using the glow discharging process.

Preparation of Surface Layer

The surface layer 104 in the light receiving member for use in electrophotography according to this invention is constituted with an amorphous material composed of $A—(Si_xC_{1-x})_y:H_{1-y}$ [$x>0$, $y<1$] which contains 41 to 70 atomic % of hydrogen atoms and is disposed on the above-mentioned photoconductive layer.

The surface layer can be properly prepared by vacuum deposition method utilizing the discharge phenomena such as glow discharging, sputtering or ion plating wherein relevant gaseous starting materials are selectively used as well as in the above-mentioned cases for preparing the photoconductive layer.

However, the glow discharging method or sputtering method is suitable since the control for the condition upon preparing the surface layer having desired properties are relatively easy, and hydrogen atoms and carbon atoms can be introduced easily together with silicon atoms. The glow discharging method and the sputtering method may be used together in on identical system.

Basically, when a layer constituted with $A—(Si_xC_{1-x})_y:H_{1-y}$ is formed, for example, by the glow discharging method, gaseous starting material capable of supplying silicon atoms (Si) are introduced together with a gaseous starting material for introducing hydrogen atoms (H) and/or halogen atoms (X) into a deposition chamber the insdie pressure of which can be reduced, glow discharge is generated in the deposition chamber, and a layer constituted with $A—(Si_xC_{1-x})_y:H_{1-y}$ containing 41 to 70 atomic % of hydrogen atoms is formed on the surface of a substrate placed in the deposition chamber.

As for the gaseous starting materials for supplying silicon atoms (Si) and/or hydrogen atoms (H), the same gaseous materials as mentioned in the above cases for preparing photoconductive layer can be used as long as they do not contain any of halogen atoms, nitrogen atoms and oxygen atoms.

That is, the gaseous starting material usable for forming the surface layer can include almost any kind of gaseous or gasifiable materials as far as it contains one or more kinds selected from silicon atoms, hydrogen atoms and carbon atoms as the constituent atoms.

Specifically, for the preparation of the surface layer, it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si) in the glow discharging process as described above.

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In the case of forming the surface layer by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, a gaseous starting material for introducing carbon atoms (C) is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering depositon chamber thereby forming gas plasmas and sputtering is carried out. As the gaseous starting material for introducing each of the atoms used in the sputtering process, those gaseous starting materials used in the glow discharging process as described above may be used as they are.

The conditions upon forming the surface layer constituted with an amorphous material composed of $A—(Si_xC_{1-x})_y:H_{1-y}$ which contains 41 to 71 atomic % of hydrogen atoms, for example, the temperature of the substrate, the gas pressure in the deposition chamber and the electric discharging power are important factors for obtaining a desirable surface layer having desired properties and they are properly selected while considering the functions of the layer to be formed. Further, since these layer forming conditions may be varied depending on the kind and the amount of each of the atoms contained in the light receiving layer, the conditions have to be determined also taking the kind or the amount of the atoms to be contained into consideration.

Specifically, the temperature of the substrate is preferably from 50° to 350° C. and, most preferably, from 100° to 300° C. The gas pressure in the deposition chamber is preferably from 0.01 to 1 Torr and, most preferably, from 0.1 to 0.5 Torr. Further, the electrical discharging power is preferably from 10 to 1000 W/cm$^2$, and, most preferably from 20 to 500 W/cm$^2$.

However, the actual conditions for forming the surface layer such as the temperature of a substrate, discharging power and the gas pressure in the deposition chamber can not usually be determined with ease independent of each other. Accordingly, the conditions optimal to the formation of the surface layer are desirably determined based on relative and organic relationships for forming the surface layer having desired properties.

DESCRIPTION OF THE PREFERRED EMBODIMENTS

The invention will be described more specifically while referring to examples 1 through 30, but the invention is no way limited only to these examples.

Figure 24:
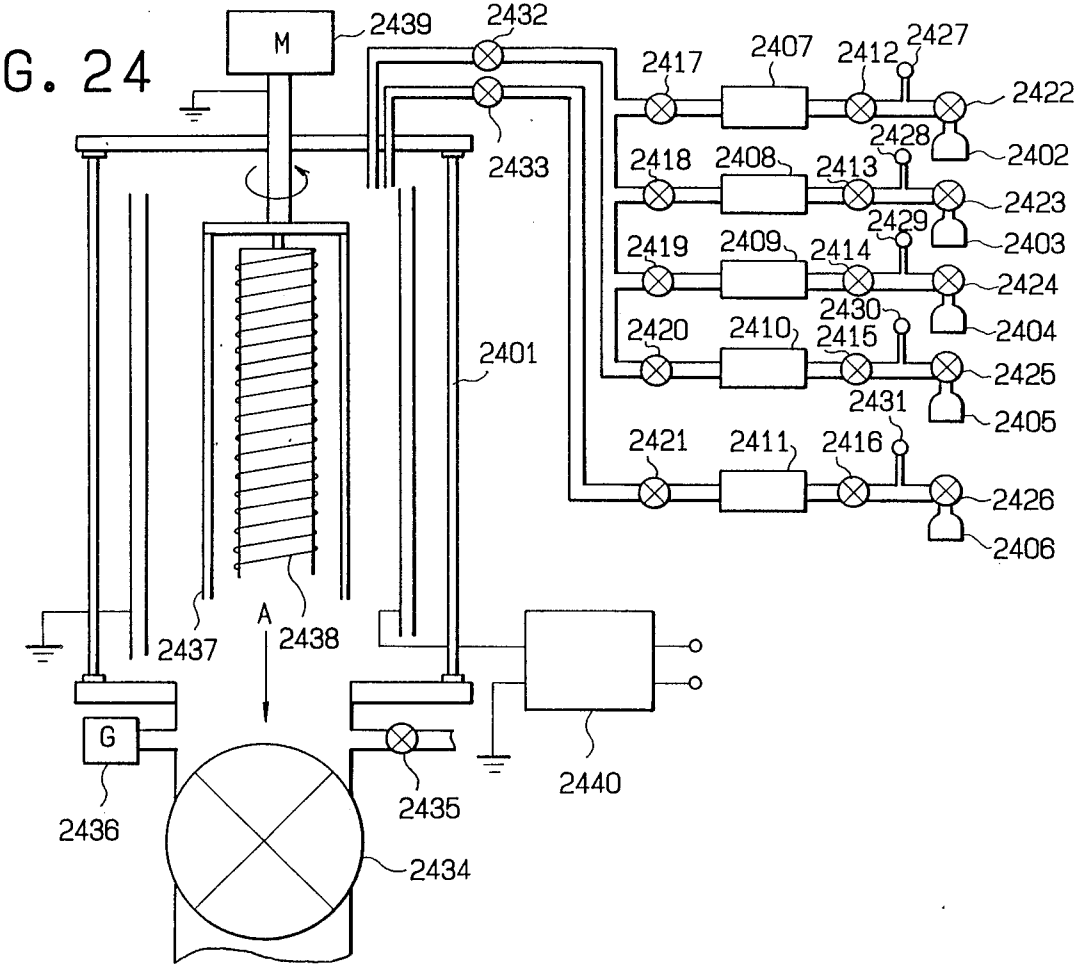
FIG. 24 is a schematic explanatory view of a fabrication apparatus for preparing the light receiving member for use in electrophotography according to this invention.

In each of the examples, the light receiving layer composed of an amorphous material was formed by using the glow discharging process. FIG. 24 shows the apparatus for preparing the light receiving member according to this invention.

Gas reservoirs 2402, 2403, 2404, 2405, and 2406 illustrated in the figure are charged with gaseous starting materials for forming the respective layers in the light receiving member for use in electrophotography according to this invention, that is, for instance, $SiH_4$ gas (99.999% purity) in the reservoir 2402, $B_2H_6$ gas (99.999% purity) diluted with $H_2$ (referred to as "$B_2H_6/H_2$") in the reservoir 2403, $H_2$ gas (99.99999% purity) in the reservoir 2404, NO gas (99.999% purity) in the reservoir 2505, and $CH_4$ gas (99.99% purity) in the reservoir 2406.

Prior to the entrance of these gases into a reaction chamber 2401, it is confirmed that valves 2422–2426 for the gas reservoirs 2402–2406 and a leak valve 2435 are closed and that inlet valves 2412–2416, exit valves 2417–2421, and sub-valves 2432 and 2433 are opened. Then, a main valve 2434 is at first opened to evacuate the inside of the reaction chamber 2401 and gas piping.

Then, upon observing that the reading on the vacuum 2436 became about $5\times10^{-6}$ Torr, the sub-valves 2432 and 2433 and the exit valves 2417 through 2421 are closed.

Now, reference is made to the example shown in FIG. 1(A) in the case of forming the photo receiving layer on an Al cylinder as a substrate 3437.

At first, $SiH_4$ gas from the gas reservoir 2402, $B_2H_6/H_2$ gas from the gas reservoir 2403, $H_2$ gas from the gas reservoir 2404, and NO gas from the gas reservoir 2505 are caused to flow into mass flow controllers 2407, 2408, 2409, and 2410 respectively by opening the inlet valves 2412, 2413, 2414, and 2415, controlling the pressure of exit pressure gauges 2427, 2428, 2429, and 2430 to 1 kg/cm$^2$. Subsequently, the exit valves 2417, 2418, 2419, and 2420, and the sub-valve 2432 are gradually opened to enter the gases into the reaction chamber 2401. In this case, the exit valves 2417, 2418, 2419, and 2420 are adjusted so as to attain a desired value for the ratio among the $SiH_4$ gas flow rate, NO gas flow rate, $CH_4$ gas flow rate, and $B_2H_6/H_2$ gas flow rate, and the opening of the main valve 2434 is adjusted while observing the reading on the vacuum gauge 2436 so as to obtain a desired value for the pressure inside the reaction chamber 2401. Then, after confirming that the temperature of the 2437 has been set by a heater 2448 within a range from 50° to 350° C., a power source 2440 is set to a predetermined electrical power to cause glow discharging in the reaction chamber 2401 while controlling the flow rates of No gas and/or $B_2H_6/H_2$ gas in accordance with a previously designed variation coefficient curve by using a microcomputer (not shown), thereby forming, at first, a charge injection inhibition layer 102 containing oxygen atoms and boron atoms on the substrate cylinder 2437. When the layer 102 has reached a desired thickness, the exit valves 2418 and 2420 are completely closed to stop $B_2H_6/H_2$ gas and NO gas into the deposition chamber 2401. At the same time, the flow rate of $SiH_4$ gas and the flow rate of $H_2$ gas are controlled by regulating the exit valves 2417 and 2419 and the layer formation process is continued to thereby form a photoconductive layer without containing both oxygen atoms and boron atoms having a desired thickness on the previously formed charge injection inhibition layer.

In the case of forming a photoconductive layer containing oxygen atoms and/or boron atoms, the flow rate for the gaseous starting material to supply such atoms in appropriately controlled in stead of closing the exit valves 2418 and/or 2420.

In the case where halogen atoms are incorporated in the charge injection inhibition layer 102 and the photoconductive layer 103, for example, $SiF_4$ gas is fed into the reaction chamber 2401 in addition to the gases as mentioned above.

And it is possible to further increase the layer forming speed according to the kind of a gas to be selected. For example, in the case where the charge injection inhibition layer 102 and the photoconductive layer 103 are formed using $Si_2H_6$ gas in stead of the $SiH_4$ gas, the layer forming speed can be increased by a few fold and as a result, the layer productivity can be enhanced.

In order to form the surface layer 104 or the resulting photoconductive layer, for example, $SiH_4$ gas, $CH_4$ gas and if necessary, a dilution gas such as $H_2$ gas are introduced into the reaction chamber 2401 by operating the corresponding valves in the same manner as in the case of forming the photoconductive layer and glow discharging is caused therein under predetermined conditions to thereby form the surface layer.

In that case, the amount of the carbon atoms to be incorporated in the surface layer can be properly controlled by appropriately changing the flow rate for the $SiH_4$ gas and that for the $CH_4$ gas respectively to be introduced into the reaction chamber 2401. As for the amount of the hydrogen atoms to be incorporated in the surface layer, it can be properly controlled by appropriately changing the flow rate of the $H_2$ gas to be introduced into the reaction chamber 2401.

All of the exit valves other than those required for upon forming the respective layers are of course closed. Further, upon forming the respective layers, the inside of the system is once evacuated to a high vacuum degree as required by closing the exit valves 2417 through 2421 while entirely opening the sub-valve 2432 and entirely opening the main valve 2434.

Further, during the layer forming operation, the Al cylinder as substrate 2437 is rotated at a predetermined speed by the action of the motor 2439.

EXAMPLE 1

A light receiving member for use in electrophotography having a light receiving layer 100 disposed on an Al cylinder having a mirror grinded surface was prepared under the layer forming conditions shown in Table 1 using the fabrication appratus shown in FIG. 24.

And, a sample having only a surface layer on the same kind Al cylinder as in the above case was prepared in the same manner for forming the surface layer in the above case using the same kind fabrication apparatus a that shown in FIG. 24.

For the resulting light receiving member (hereinafter, this kind light receiving member is referred to as "drum"), it was set with the conventional electrophotographic copying machine, and electrophotographic characteristic s such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

As for the resulting sample, upper part, middle part and lower part of its image forming part were cut off, and were engaged in quantitative analysis by the conventional organic element analyzer to analyze the content of hydrogen atoms in each of the cut-off parts.

The results of the various evaluations and the results of the quantitative analysis of the content of the hydrogen atoms are as shown in Table 2. As Table 2 illustrates, considerable advantages on items of initial electrification efficiency, effective image flow and sensitivity deterioration were acknowledged.

COMPARATIVE EXAMPLE 1

Except that the layer forming conditions changed as shown in Table 3, the drum and the sample were made under the same fabrication apparatus and manner as Example 1 and were provided to examine the same items. The results are shown in Table 4. As the Table 4 illustrates, much defects on various items were acknowledged compared to the case of Example 1.

EXAMPLE 2

A light receiving member for use in electrophotography having a light receiving layer 100 disposed on an Al cylinder having a mirror plane surface was prepared under the layer forming conditions shown in Table 5 using the fabrication apparatus shown in FIG. 24.

And a sample having only a surface layer on the same kind Al cylinder as in the above case was prepared in the same manner for forming the surface layer in the above case using the same kind fabrication apparatus as that shown in FIG. 24.

For the resulting light receiving member (hereinafter, this kind light receiving member is referred to as "drum"), it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow or the drum under high temperature and high humidity atmosphere at 35° C. and 85% humidity was also examined.

As for the resulting sample, upper part, middle part and lower part of its image forming part were cut off, and were engaged in quantitative analysis by the conventional organic element analyzer to analyze the content of hydrogen atoms in each of the cut-off parts.

Figure 27:
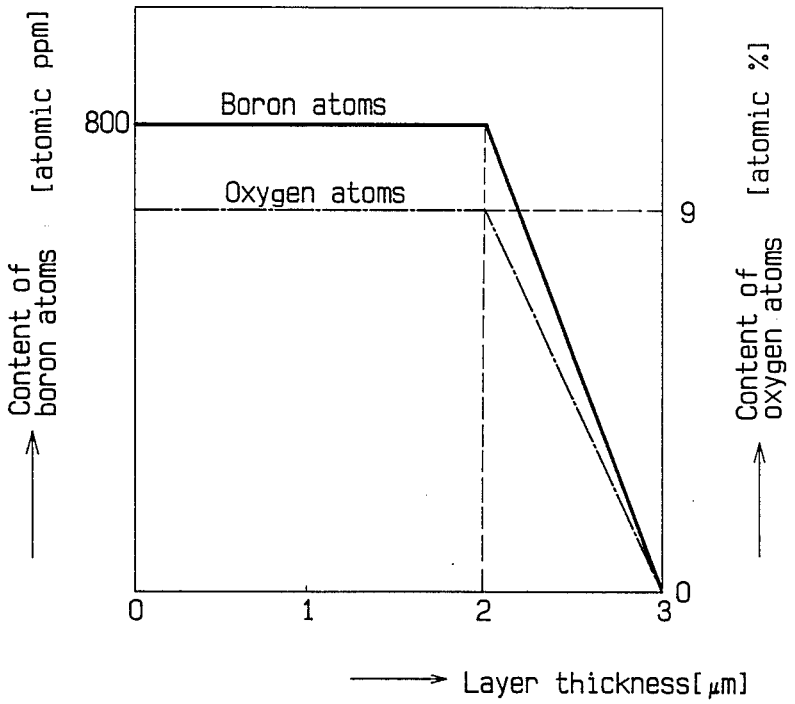
FIG. 27 is a view illustrating the thicknesswise distribution of boron atoms and oxygen atoms in the charge injection inhibition layer in Example 2.

The results of the various evaluations and the results of the quantitative analysis of the content of the hydrogen atoms are as shown in Table 6. And the content profiles of boron atoms (B) and oxygen atoms (O) in the thicknesswise direction in the charge injection inhibiton layer are shown in FIG. 27.

As Table 6 illustrates, considerable advantages on items of initial electrification efficiency, defective image flow and sensitivity deterioration were acknowledged.

EXAMPLE 3

(containing Comparative Example 2)

Multiple drums and samples for analysis were provided under the same conditions as in Example 1, except the conditions for forming a surface layer were changed to those shown in Table 7.

As a result of subjecting these drums and samples to the same evaluations and analysises as in Example 1, the results shown in Table 8 were obtained.

EXAMPLE 4

With the layer forming conditions for a photoconductive layer changed to the figures of Table 9, multiple drums having a light receiving layer under the same conditions as in Example 1 were provided. These drums were examined by the same procedures as in Example 1. The results are shown in Table 10.

EXAMPLE 5

With the layer forming conditions for a charge injection inhibition layer changed to the figures of Table 11, multiple drums having a light receiving layer under the same conditions as in Example 1 were under the same conditions as in Example 1 were provided. These drums were examined by the same procedures as in Example 1. The results are shown in Table 12.

EXAMPLE 6

With the layer forming conditions for a charge injection inhibition layer changed to the figures of Table 13, multiple drums having a light receiving layer under the same conditions as in Example 1 were provided. These drums were examined by the same procedures as in Example 1. The results are shown in Table 14.

EXAMPLE 7

Figure 25:
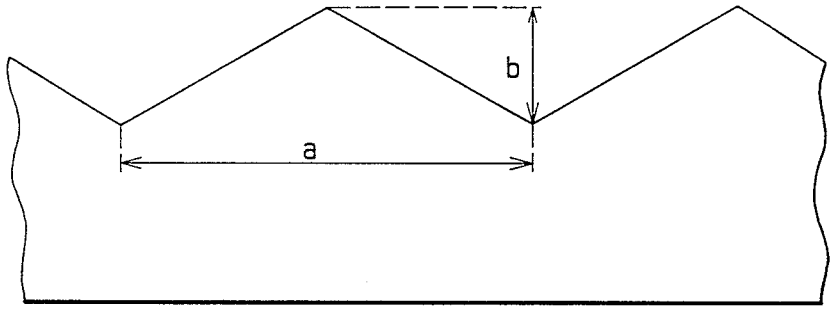
FIG. 25 and FIG. 26 are schematic views respectively illustrating the shape of the surface of the substrate in the light receiving member in Examples 7, 17 and 28, and Examples 8, 18 and 29.

The mirror ground cylinders were supplied for the grinding process of cutting tool of various degrees. With the patterns of FIG. 25, various cross section patterns as described in Table 15, multiple cylinders were provided. These cylinders were set to the fabrication apparatus of FIG. 24 accordingly, and used to produce drums under the same production conditions of Example 1. The produced drums are evaluated with the conventional electrophotographic copying machine having digital exposure functions and using semiconductor laser of 780 nm wavelength. The results were as shown in Table 16.

EXAMPLE 8

Figure 26:
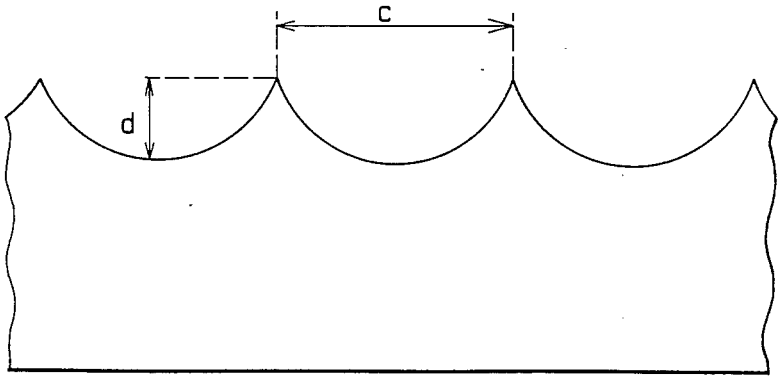

The surface of mirror ground cylinders were dimple processed by dropping many of bearing balls. Multiple cylinders having a pattern as shown in FIG. 26 and of cross section pattern of Table 17 were provided. These cylinders were set to the fabrication apparatus of FIG. 24 accordingly and used for the production of drums under the same conditions of Example 1. The produced drums are evaluated by the same electrophotographic copying machine as used in Example 7. The results were as shown in Table 18.

EXAMPLE 9

A light receiving member for use in electrophotography having a light receiving layer 100 disposed on an Al cylinder having a mirror plane surface was prepared under the layer forming conditions shown in Table 19 using the fabrication apparatus shown in FIG. 24.

And sample having only a surface layer on the same kind Al cylinder as in the above case was prepared in the same manner for forming the surface layer in the above case using the same kind fabrication appratus as that shown in FIG. 24.

For the resulting light receiving member (hereinafter, this kind of light receiving member is referred to as "drum"), it was set with the conventional electrophotographic copying machine having digital exposure functions and using semiconductor laser of 780 nm wavelength, and electrophotographic characteristic such as initial electrification efficiency, residual voltage and appearance of a ghost were examined, then decrease in the electrification efficiency, deterioration on photosensitivity and increase of defective images after 1,500 thousand times repeated shots wer respectively examined.

Further, the situation of an image flow on the drum under high temperature and high humidity atmosphere at 35° C. and 85% humidity was also examined.

As for the resulting sample, upper part, middle part and lower part of its image forming part were cut off, and were subjected to in quantitative analysis by the conventional organic element analyzer to analyze the content of hydrogen atoms in each of the cut-off parts.

The results of the various evaluations and the results of the quantitative analysis of the content of the hydrogen atoms are as shown in Table 20. As Table 20 illustrates, considerable advantages on items of initial electrification efficiency, defective image flow and sensitivity deterioration were acknowledged.

COMPARATIVE EXAMPLE 3

Except that the layer forming conditions changed as shown in Table 21, the drum and the sample were made under the same fabrication apparatus and manner as Example 9 and were provided to examine the same items. The results are shown in Table 22. As the Table 22 illustrates, much defects on various items were acknowledged compared to the case of Example 9.

EXAMPLE 10

A light receiving member for use in electrophotography having a light receiving layer 100 disposed on an Al cylinder having a mirror plane surface was prepared under the layer forming conditions shown in Table 23 using the fabrication apparatus shown in FIG. 24.

A sample having only a surface layer on the same kind Al cylinder as in the above case was prepared in the same manner for forming the surface layer in the above case using the same kind of fabrication apparatus as that shown in FIG. 24.

For the resulting light receiving member (hereinafter, this kind of light receiving member is referred to as "drum"), it was set with the conventional electrophotographic copying machine having digital exposure functions and using semiconductor laser of 780 nm wavelength, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

As for the resulting sample, upper part, middle part and lower part of its image forming part were cut off, and were engaged in quantitative analysis by the conventional organic element analyzer to analyze the content of hydrogen atoms in each of the cut-off parts.

Figure 28:
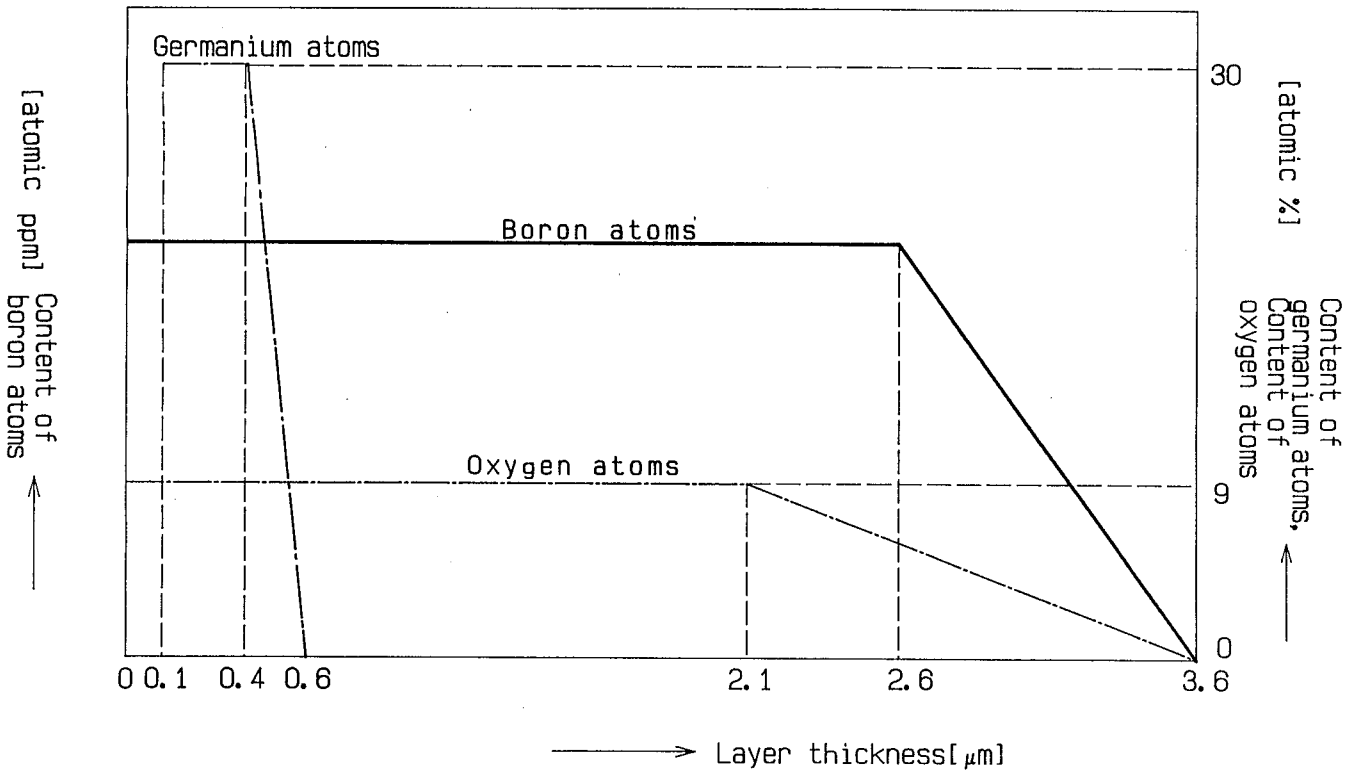
FIG. 28 is a view illustrating the thicknesswise distribution of boron atoms and oxygen atoms in the charge injection inhibition layer and germanium atoms in IR layer in Example 10 and 20.

The results of the various evaluations and the results of the quantitative analysis of the content of the hydrogen atoms are as shown in Table 24. The content profiles of boron atoms (B) and oxygen atoms (O) in the thicknesswise direction in the charge injection inhibition layer and content profiles of germanium atoms (Ge) in the IR layer are shown in FIG. 28.

As Table 24 illustrates, considerable advantages on items of initial electrification efficiency, defective image flow and sensitivity deterioration were acknowledged.

EXAMPLE 11

(containing Comparative Example 4)

Multiple drums and samples for analysis were provided under the same conditions as in Example 1, except the conditions for forming a surface layer were changed to those shown in Table 25.

As a result of subjecting these drums and samples to the same evaluations and analysis as in Example 9, the results shown in Table 26 were obtained.

EXAMPLE 12

With the layer forming conditions for a photoconductive layer changed to the figures of Table 27, multiple drums having a light receiving layer under the same conditions as in Example 9 were provided. These drums were examined by the same procedures as in Example 1. The results are shown in Table 28.

EXAMPLE 13

With the layer forming conditions for a charge injection inhibition layer changed to the figures of Table 29, multiple drums having a light receiving layer under the same conditions as in Example 9 were provided. These drums were examined by the same procedures as in Example 1. The results are shown in Table 30.

EXAMPLE 14

With the layer forming conditions for a charge injection inhibition layer changed to the figures of Table 31, multiple drums having a light receiving layer under the same conditions as in Example 9 were provided. These drums were examined by the same procedures as in Example 9. The results are shown in Table 32.

EXAMPLE 15

With the layer forming conditions for an IR layer changed to the figures of Table 33, multiple drums having a light receiving layer under the same conditions as in Example 9 were provided. These drums were examined by the same procedures as in Example 9. The results are shown in Table 34.

EXAMPLE 16

With the layer forming conditions for an IR layer changed to the figures of Table 35, multiple drums having a light receiving layer under the same conditions as in Example 9 were provided. These drums were examined by the same procedures as in Example 9. The results are shown in Table 36.

EXAMPLE 17

The mirror ground cylinders were supplied for the grinding process of a cutting tool of various degrees. With the patterns of FIG. 25, various cross section patterns as described in Table 37 multiple cylinders were provided. These cylinders were set to the fabrication apparatus of FIG. 24 accordingly, and used to produce drums under the same production conditions of Example 9. The produced drums are evaluated with the conventional electrophotographic copying machine having digital exposure functions and using semiconductor laser of 780 nm wavelength. The results were as shown in Table 38.

EXAMPLE 18

The surface of mirror ground cylinders were subjected to dimpling processing by dropping many ball bearings. Multiple cylinders having a pattern as shown in FIG. 26 and of cross section pattern of Table 39 were provided. These cylinders were set to the fabrication apparatus of FIG. 24 accordingly and used for the production of drums under the same conditions of Example 1. The produced drums are evaluated by the same electrophotographic copying machine as used in Example 17. The results were as shown in Table 40.

EXAMPLE 19

A light receiving member for use in electrophotography having a light receiving layer 100 disposed on an Al cylinder having a mirror plane surface was prepared under the layer forming conditions shown in Table 41 using the fabrication apparatus shown in FIG. 24.

A sample having only a surface layer on the same kind Al cylinder as in the above case was prepared in the same manner for forming the surface layer in the above case using the same kind fabrication apparatus as that shown in FIG. 24.

For the resulting light receiving member (hereinafter, this kind light receiving member is referred to as "drum"), it was set with the conventional electrophotographic copying machine having digital exposure functions and using semiconductor laser of 780 nm wavelength, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

As for the resulting sample, upper part, middle part and lower part of its image forming part were cut off, and were subjected to quantitative analysis by the conventional organic element analyzer to analyze the content of hydrogen atoms in each of the cut-off parts.

The results of the various evaluations and the results of the quantitative analysis of the content of the hydrogen atoms are as shown in Table 42. As Table 42 illustrates, considerable advantages on items of initial electrification efficiency, defective image flow and sensitivity deterioration were acknowledged.

COMPARATIVE EXAMPLE 5

Except that the layer forming conditions changed as shown in Table 43, the drum and the sample were made under the same fabrication apparatus and manner as Example 19 and were provided to examine the same items. The results are shown in Table 44. As the Table 44 illustrate, much defects on various items were acknowledged compared to the case of Example 19.

EXAMPLE 20

A light receiving member for use in electrophotography having a light receiving layer 100 disposed on an Al cylinder having a mirror plane surface was prepared under the layer forming conditions shown in Table 45 using the fabrication apparatu shown in FIG. 24.

A sample having only a surface layer on the same kind Al cylinder as in the above case was prepared in the same manner for forming the surface layer in the above case using the same kind fabrication apparatus as that shown in FIG. 24.

For the resulting light receiving member (hereinafter, this kind of light receiving member is referred to as "drum"), it was set with the conventional electrophotographic copying machine having digital exposure functions and using semiconductor laser of 780 nm wavelength, and electrophotographic characteristics such as the beginning electrification efficiency, residual voltage and appearance of a ghost were examined, then decrease in the electrification efficiency, deterioration on the photosensitivity and increase of defective images after the repeating use for 1,500 thousand times were examined.

Further, the situation of an image flow on the drum under high temperature and high moisture atmosphere at 35° C. and 85% humidity was also examined.

As for the resulting sample, upper part, middle part and lower part of its image forming part were cut off, and were subjected to quantitative analysis by the conventional organic element analyzer to examine the content of hydrogen atoms in each of the cut-off parts.

The results of the various evaluations and the results of the quantitative analysis of the content of the hydrogen atoms are as shown in Table 46. And the content profiles of boron (B) and oxygen atoms (O) in the thicknesswise direction in the charge injection inhibition layer and the content profiles of germanium atoms (Ge) in the IR layer are shown in FIG. 28.

As Table 46 illustrates, considerable advantages on items of initial electrification efficiency, defective image flow and sensitivity deterioration were acknowledged.

EXAMPLE 21

(containing Comparative Example 6)

Multiple drums and samples for analysis were provided under the same conditions as in Example 19, except the conditions for forming a surface layer were changed to those shown in Table 47.

As a result of subjecting these drums and samples to the same evaluations and analysis as in Example 19, the results shown in Table 48 were obtained.

EXAMPLE 22

With the layer forming conditions for a photoconductive layer changed to the figures of Table 49, multiple drums having a light receiving layer under the same conditions as in Example 19 were provided. These drums were examined by the same procedures as in Example 19. The results are shown in Table 50.

EXAMPLE 23

With the layer forming conditions for a charge injection inhibition layer changed to the figures of Table 51, multiple drums having a light receiving layer under the same conditions as in Example 19 were provided. These drums were examined by the same procedures as in Example 19. The results are shown in Table 52.

EXAMPLE 24

With the layer forming conditions for a charge injection inhibition layer changed to the figures of Table 53, multiple drums having a light receiving layer under the same conditions as in Example 19 were provided. These drums were examined by the same procedures as in Example 19. The results are shown in Table 54.

EXAMPLE 25

With the layer forming conditions for an IR layer changed to the figures of Table 55, multiple drums having a light receiving layer under the same conditions as in Example 19 were provided. These drums were examined by the same procedures as in Example 19. The results are shown in Table 56.

EXAMPLE 26

With the layer forming conditions for an IR layer changed to the figures of Table 57, multiple drums having a light receiving layer under the same conditions as in Example 19 were provided. These drums were examined by the same procedures as in Example 19. The results are shown in Table 58.

EXAMPLE 27

With the layer forming conditions for a contact layer changed to the figures of Table 59, multiple drums having a light receiving layer under the same conditions as in Example 19 were provided. These drums were examined by the same procedures as in Example 19. The results are shown in Table 60.

EXAMPLE 28

The mirror ground cylinders were supplied for the grinding process employing a cutting tool of various degrees. With the patterns of FIG. 25, various cross section patterns as described in Table 61, multiple cylinders were provided. These cylinders were set to the fabrication apparatus of FIG. 24 accordingly, and used to produce drums under the same production conditions of Example 19. The produced drums are evaluated with the conventional electrophotographic copying machine having digital exposure functions and using semiconductor laser of 780 nm wavelength. The results were as shown in Table 62.

EXAMPLE 29

The surface of mirror ground cylinders were dimple processed by dropping many ball bearings. Multiple cylinders having a pattern as shown in FIG. 26 and of cross section pattern of Table 63 were provided. These cylinders were set to the fabrication apparatus of FIG. 24 accordingly and used for the production of drums under the same conditions of Example 1. The produced drums are evaluated by the same electrophotographic copying machine as used in Example 28. The results were as shown in Table 64.

EXAMPLE 30

A light receiving member for use in electrophotography having a light receiving layer 100 disposed on an Al cylinder having a mirror grounded surface was prepared under the layer forming conditions shown in Table 65 using the fabrication apparatus shown in FIG. 24.

And, a sample having only a surface layer on the same kind Al cylinder as in the above case was prepared in the same manner for forming the surface layer in the above case using the same kind fabrication apparatus as that shown in FIG. 24.

For the resulting light receiving member (hereinafter, this kind light receiving member is referred to as "drum"), it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

As for the resulting sample, upper part, middle part and lower part of its image forming part were cut off, and were engaged in quantitative analysis by the conventional organic element analyzer to analyze the content of hydrogen atoms in each of the cut-off parts.

The results of the various evaluations and the results of the quantitative analysis of the content of the hydrogen atoms are as shown in Table 66. As Table 66 illustrates, considerable advantages on items of initial electrification efficiency, defective image flow and sensitivity deterioration were acknowledged.

COMPARATIVE EXAMPLE 7

Except that the layer forming conditions changed as shown in Table 67, the drum and the sample were made under the same fabrication apparatus and manner as Example 30 and were provided to examine the same items. The results are as shown in Table 68. As the Table 68 illustrates, much defects on various items were acknowledged compared to the case of Example 30.

TABLE 1

| Name of layer | Gas used and flow rate (SCCM) | | Substrate temperature (°C.) | RF power (W) | Internal pressure (torr) | Layer thickness (μm) |
|---|---|---|---|---|---|---|
| Charge | $SiH_4$ | 150 | 250 | 150 | 0.25 | 3 |
| injection | $B_2H_6$ (against $SiH_4$) | 1000 ppm | | | | |
| inhibition | NO | 10 | | | | |
| layer | $H_2$ | 350 | | | | |

TABLE 1-continued

| Name of layer | Gas used and flow rate (SCCM) | | Substrate temperature (°C.) | RF power (W) | Internal pressure (torr) | Layer thickness (μm) |
|---|---|---|---|---|---|---|
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 500 | | | | |
| | $H_2$ | 500 | | | | |

TABLE 2

| Initial electrification efficiency | Initial sensitivity | Image flow | Residual voltage | Ghost | Defective image | Deterioration of sensitivity | Increase of defective image | Hydrogen content (atomic %) |
|---|---|---|---|---|---|---|---|---|
| ◉ | ○ | ◉ | ◉ | ◉ | ○ | ○ | ○ | 52 |

◉ Excellent
○ good
Δ practically applicable
x poor

TABLE 3

| Name of layer | Gas used and flow rate (SCCM) | | Substrate temperature (°C.) | RF power (W) | Internal pressure (torr) | Layer thickness (μm) |
|---|---|---|---|---|---|---|
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 150 | 100 | 0.7 | 0.5 |
| | $CH_4$ | 500 | | | | |
| | $H_2$ | 1000 | | | | |

TABLE 4

| Initial electrification efficiency | Initial sensitivity | Image flow | Residual voltage | Ghost | Defective image | Deterioration of sensitivity | Increase of defective image | Hydrogen content (atomic %) |
|---|---|---|---|---|---|---|---|---|
| x | ○ | ○ | x | Δ | x | ○ | x | 87 |

◉ Excellent
○ good
Δ practically applicable
x poor

TABLE 5

| Name of layer | Gas used and flow rate (SCCM) | | Substrate temperature (°C.) | RF power (W) | Internal pressure (torr) | Layer thickness (μm) |
|---|---|---|---|---|---|---|
| Charge injection inhibition layer | $SiH_4$ | 150 | 250 | 150 | 0.25 | 3 |
| | $B_2H_6$ (against $SiH_4$) | 1000 ppm → 0 | | | | |
| | NO | 10 → 0 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.4 | 0.5 |
| | $CH_4$ | 400 | | | | |
| | $H_2$ | 300 | | | | |

TABLE 6

| Initial electrification efficiency | Initial sensitivity | Image flow | Residual voltage | Ghost | Defective image | Deterioration of sensitivity | Increase of defective image | Hydrogen content (atomic %) |
|---|---|---|---|---|---|---|---|---|
| ◉ | ○ | ◉ | ◉ | ◉ | ○ | ○ | ◉ | 43 |

◉ Excellent
○ Good
Δ Practically applicable
x Poor

TABLE 7

| Drum No. | 301 | 302 | 303 | 304 | 305 | Comparative Example 2 |
|---|---|---|---|---|---|---|
| Flow rate (SCCM) | $SiH_4$ 10<br>$CH_4$ 500<br>$H_2$ 300 | $SiH_4$ 10<br>$CH_4$ 500<br>$H_2$ 500 | $SiH_4$ 10<br>$CH_4$ 500<br>$H_2$ 700 | $SiH_4$ 10<br>$CH_4$ 500<br>$H_2$ 700 | $SiH_4$ 10<br>$CH_4$ 500<br>$H_2$ 700 | $SiH_4$ 10<br>$CH_4$ 500<br>$H_2$ 800 |
| Substrate temperature (°C.) | 250 | 250 | 250 | 150 | 150 | 100 |
| RF power (W) | 200 | 100 | 200 | 200 | 100 | 150 |
| Internal pressure (torr) | 0.4 | 0.45 | 0.48 | 0.48 | 0.48 | 0.65 |
| Layer thickness (μm) | 0.5 | 0.5 | 0.5 | 0.5 | 0.5 | 0.5 |

TABLE 8

| Drum No. | Initial electrification efficiency | Initial sensitivity | Image flow | Residual voltage | Ghost | Difective image | Deterioration of sensitivity | Increase of defective image | Sample No. | Hydrogen content (atomic %) |
|---|---|---|---|---|---|---|---|---|---|---|
| 301 | ◉ | ○ | ○ | ◉ | ○ | ○ | ○ | ○ | 301 | 43 |
| 302 | ○ | ○ | ◉ | ◉ | ◉ | ○ | ○ | ○ | 302 | 59 |
| 303 | ○ | ○ | ◉ | ◉ | ◉ | ○ | ○ | ○ | 303 | 60 |
| 304 | ○ | ○ | ◉ | ○ | ◉ | ○ | ○ | ○ | 304 | 66 |
| 305 | ○ | ○ | ◉ | ○ | ◉ | ○ | ○ | ○ | 305 | 69 |
| Comparative Example 2 | x | ○ | ○ | x | Δ | x | ○ | x | Comparative Example 2 | 85 |

◉ Excellent
○ Good
Δ Practically applicable
x Poor

TABLE 9

| Drum No. | 401 | 402 | 403 | 404 | 405 | 406 |
|---|---|---|---|---|---|---|
| Flow rate (SCCM) | $SiH_4$ 350<br>NO 50 | $SiH_4$ 200<br>$H_2$ 600 | $SiH_4$ 350<br>$H_2$ 350<br>$B_2H_6$ 0.3 ppm (against $SiH_4$) | $SiH_4$ 350<br>Ar 350 | $SiH_4$ 350<br>He 350<br>$B_2H_6$ 0.3 ppm (against $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Internal pressure (torr) | 0.4 | 0.42 | 0.4 | 0.45 | 0.4 | 0.38 |
| Layer thickness (μm) | 20 | 20 | 20 | 20 | 20 | 20 |

TABLE 10

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 401 | ○ | ◉ | ◉ | ◉ | ◉ | ○ | ○ | ○ |
| 402 | ◉ | ○ | ◉ | ◉ | ◉ | ○ | ○ | ○ |
| 403 | ○ | ○ | ◉ | ◉ | ◉ | ○ | ○ | ○ |
| 404 | ◉ | ○ | ◉ | ◉ | ◉ | ○ | ○ | ○ |

TABLE 10-continued

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 405 | ○ | ○ | ◉ | ◉ | ◉ | ○ | ○ | ○ |
| 406 | ◉ | ○ | ◉ | ◉ | ◉ | ○ | ○ | ○ |

◉ Excellent
○ Good
Δ Practically applicable
x Poor

TABLE 11

| Drum No. | 501 | 502 | 503 | 504 | 505* | 506 |
|---|---|---|---|---|---|---|
| Flow rate (SCCM) | $SiH_4$ 150<br>$B_2H_6$ 500 ppm (against $SiH_4$)<br>NO 10<br>$H_2$ 350 | $SiH_4$ 150<br>$B_2H_6$ 100 ppm (against $SiH_4$)<br>NO 5<br>$H_2$ 350 | $SiH_4$ 150<br>$PH_3$ 100 ppm (against $SiH_4$)<br>NO 5<br>$H_2$ 350 | $SiH_4$ 150<br>$B_2H_6$ 500 ppm (against $SiH_4$)<br>NO 10<br>Ar 350 | $SiH_4$ 150<br>$B_2H_6$ 1000 ppm (against $SiH_4$)<br>NO 10<br>He 350 | $SiH_4$ 100<br>$SiF_4$ 50<br>$B_2H_6$ 500 ppm (against $SiH_4$)<br>NO 10<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness (μm) | 3 | 3 | 3 | 3 | 3 | 2.7 |

*only the conditions for the photoconductive layer are the same as in the case of the drum No. 405

TABLE 12

| Drum No. | Initial electrification efficiency | Initial sensitivity | Image flow | Residual voltage | Ghost | Defective image | Deterioration of sensitivity | Increase of defective image | Remarks |
|---|---|---|---|---|---|---|---|---|---|
| 501 | ◉ | ○ | ○ | ◉ | ◉ | ○ | ○ | ○ | (—) electrification |
| 502 | ○ | ○ | ◉ | ◉ | ◉ | ○ | ○ | ○ | |
| 503 | ○ | ○ | ○ | ○ | ○ | ○ | ○ | ○ | |
| 504 | ◉ | ○ | ○ | ◉ | ○ | ○ | ○ | ○ | |
| 505 | ○ | ○ | ◉ | ◉ | ◉ | ○ | ○ | ○ | |
| 506 | ◉ | ○ | ○ | ○ | ○ | ○ | ○ | ○ | |

◉ Excellent
○ Good
Δ Practically applicable
x Poor

TABLE 13

| Drum No. | 601 | 602 | 603 | 604 | 605* | 606 |
|---|---|---|---|---|---|---|
| Flow rate (SCCM) | $SiH_4$ 150<br>$B_2H_6$ 500 ppm → 0 (against $SiH_4$)<br>NO 10 → 0<br>$H_2$ 350 | $SiH_4$ 150<br>$B_2H_6$ 100 ppm → 0 (against $SiH_4$)<br>NO 5 → 0<br>$H_2$ 350 | $SiH_4$ 150<br>$PH_3$ 100 ppm → 0 (against $SiH_4$)<br>NO 5 → 0<br>$H_2$ 350 | $SiH_4$ 150<br>$B_2H_6$ 500 ppm → 0 (against $SiH_4$)<br>NO 10 → 0<br>Ar 350 | $SiH_4$ 150<br>$B_2H_6$ 1000 ppm → 0 (against $SiH_4$)<br>NO 10 → 0<br>He 350 | $SiH_4$ 100<br>$SiF_4$ 50<br>$B_2H_6$ 500 ppm → 0 (against $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness (μm) | 3 | 3 | 3 | 3 | 3 | 2.7 |

Only the conditions for the photoconductive layer are the same as in the case of the drum No. 405

TABLE 14

| Drum No. | Initial electrification efficiency | Initial sensitivity | Image flow | Residual voltage | Ghost | Defective image | Deterioration of sensitivity | | Increase of defective image |
|---|---|---|---|---|---|---|---|---|---|
| 601 | ◉ | ○ | ○ | ◉ | ◉ | ◉ | ◉ | ○ | ◉ |
| 602 | ○ | ○ | ◉ | ◉ | ◉ | ◉ | ○ | ○ | ○ |
| 603 | ○ | ○ | ○ | ◉ | ◉ | ◉ | ○ | ○ | ○ |
| 604 | ◉ | ○ | ○ | ◉ | ○ | ○ | ○ | ○ | ○ |
| 605 | ○ | ○ | ◉ | ◉ | ◉ | ◉ | ○ | ○ | ◉ |
| 606 | ◉ | ○ | ○ | ◉ | ○ | ○ | ○ | ○ | ○ |

◉ Excellent
○ Good
Δ Practically applicable
x Poor

TABLE 15

| Drum No. | 701 | 702 | 703 | 704 | 705 |
|---|---|---|---|---|---|
| a [μm] | 25 | 50 | 50 | 12 | 12 |
| b [μm] | 0.8 | 2.5 | 0.8 | 1.5 | 0.3 |

TABLE 17

| Drum No. | 801 | 802 | 803 | 804 | 805 |
|---|---|---|---|---|---|
| a [μm] | 50 | 100 | 100 | 30 | 30 |
| b [μm] | 2 | 5 | 1.5 | 2.5 | 0.7 |

TABLE 16

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 701 | ◉ | ○ | ◉ | Δ | ◉ | ◉ | ○ | ○ | ○ | ○ |
| 702 | ◉ | ○ | ◉ | ○ | ◉ | ◉ | ○ | ○ | ○ | Δ |
| 703 | ◉ | ○ | ◉ | Δ | ◉ | ◉ | ○ | ○ | ○ | Δ |
| 704 | ◉ | ○ | ◉ | ○ | ◉ | ◉ | ○ | ○ | ○ | ○ |
| 705 | ◉ | ○ | ◉ | Δ | ◉ | ◉ | ○ | ○ | ○ | Δ |

◉ Excellent
○ Good
Δ Practically applicable
x Poor

TABLE 18

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 801 | ◉ | ○ | ◉ | Δ-○ | ◉ | ◉ | ○ | ○ | ○ | Δ |
| 802 | ◉ | ○ | ◉ | ○ | ◉ | ◉ | ○ | ○ | ○ | Δ |
| 803 | ◉ | ○ | ◉ | Δ | ◉ | ◉ | ○ | ○ | ○ | Δ |
| 804 | ◉ | ○ | ◉ | ○ | ◉ | ◉ | ○ | ○ | ○ | ○ |
| 805 | ◉ | ○ | ◉ | Δ-○ | ◉ | ◉ | ○ | ○ | ○ | Δ-○ |

◉ Excellent
○ Good
x Practically applicable
Δ Poor

TABLE 19

| Name of layer | Gas used and flow rate (SCCM) | | Substrate temperature (°C.) | RF power (W) | Internal pressure (torr) | Layer thickness (μm) |
|---|---|---|---|---|---|---|
| IR layer | $SiH_4$ | 150 | 250 | 150 | 0.27 | 0.5 |
| | $B_2H_6$ (against $SiH_4$) | 1000 ppm | | | | |
| | NO | 10 | | | | |
| | $GeH_4$ | 50 | | | | |
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 500 | | | | |
| | $H_2$ | 500 | | | | |

TABLE 20

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| ◉ | ○ | ◉ | ○ | ◉ | ◉ | ○ | ○ | ○ | 52 |

◉ Excellent
○ Good
Δ Practically applicable
x Poor

TABLE 21

| Name of layer | Gas used and flow rate (SCCM) | | Substrate temperature (°C.) | RF power (W) | Internal pressure (torr) | Layer thickness (μm) |
|---|---|---|---|---|---|---|
| IR layer | $SiH_4$ | 150 | 250 | 150 | 0.27 | 0.5 |
| | $B_2H_6$ (against $SiH_4$) | 1000 ppm | | | | |
| | NO | 10 | | | | |
| | $GeH_4$ | 50 | | | | |
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 10 | 150 | 100 | 0.7 | 0.5 |
| | $CH_4$ | 500 | | | | |
| | $H_2$ | 1000 | | | | |

TABLE 22

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| x | ○ | ○ | ○ | x | Δ | x | ○ | x | 87 |

◉ Excellent
○ Good
Δ Practically applicable
x Poor

TABLE 23

| Name of layer | Gas used and flow rate (SCCM) | | Substrate temperature (°C.) | RF power (W) | Internal pressure (torr) | Layer thickness (μm) |
|---|---|---|---|---|---|---|
| IR layer | $SiH_4$ | 150 | 250 | 150 | 0.27 | 0.5 |
| | $B_2H_6$ (against $SiH_4$) | 1000 ppm | | | | |
| | NO | 10 | | | | |
| | $GeH_4$ | 50 → 0 | | | | |
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 → 0 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 400 | | | | |
| | $H_2$ | 300 | | | | |

TABLE 24

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| ◉ | ○ | ◉ | ◉ | ◉ | ◉ | ○ | ○ | ◉ | 43 |

◉ Excellent
○ Good
Δ Practically applicable
x Poor

TABLE 25

| Drum No. | 1101 | 1102 | 1103 | 1104 | 1105 | 1106 | Comparative Example 4 |
|---|---|---|---|---|---|---|---|
| Flow rate (SCCM) | $SiH_4$ 10<br>$CH_4$ 500<br>$H_2$ 300 | $SiH_4$ 10<br>$CH_4$ 500<br>$H_2$ 500 | $SiH_4$ 10<br>$CH_4$ 500<br>$H_2$ 700 | $SiH_4$ 10<br>$CH_4$ 500<br>$H_2$ 700 | $SiH_4$ 10<br>$CH_4$ 500<br>$H_2$ 700 | $SiH_4$ 10<br>$SiF_4$ 10<br>$CH_4$ 500<br>$H_2$ 500 | $SiH_4$ 10<br>$CH_4$ 500<br>$H_2$ 800 |
| Substrate temperature (°C.) | 250 | 250 | 250 | 150 | 150 | 250 | 100 |
| RF power (W) | 200 | 100 | 200 | 200 | 100 | 200 | 150 |
| Internal pressure (torr) | 0.4 | 0.45 | 0.48 | 0.48 | 0.48 | 0.46 | 0.65 |
| Layer thickness (μm) | 0.5 | 0.5 | 0.5 | 0.5 | 0.5 | 0.5 | 0.5 |

TABLE 26

| Drum No. | Initial electrification efficiency | Initial sensitivity | Image flow | Interference fringe | Residual voltage | Ghost | Defective image | Deterioration of sensitivity | Increase of defective image | Sample No. | Hydrogen content (atomic %) |
|---|---|---|---|---|---|---|---|---|---|---|---|
| 1101 | ◉ | ○ | ○ | ○ | ◉ | ○ | ○ | ○ | ○ | 1101-1 | 46 |
| 1102 | ◉ | ◉ | ◉ | ○ | ◉ | ◉ | ○ | ○ | ○ | 1102-1 | 60 |
| 1103 | ○ | ○ | ◉ | ○ | ◉ | ◉ | ○ | ○ | ○ | 1103-1 | 61 |
| 1104 | ○ | ○ | ◉ | ○ | ○ | ◉ | ○ | ○ | ○ | 1104-1 | 65 |
| 1105 | ○ | ○ | ○ | ○ | ○ | ○ | ○ | ○ | ○ | 1105-1 | 70 |
| 1106 | ◉ | ○ | ◉ | ○ | ◉ | ◉ | ○ | ○ | ○ | 1106-1 | 55 |
| Comparative Example 4 | x | ○ | ○ | ○ | x | Δ | x | ○ | x | Comparative Example 4-1 | 85 |

◉ Excellent
○ Good
Δ Practically applicable
x Poor

TABLE 27

| Drum No. | 1201 | 1202 | 1203 | 1204 | 1205 | 1206 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (against $SiH_4$) | $SiH_4$ 350<br>Ar 350 | $SiH_4$ 350<br>He 350<br>$B_2H_6$ 0.3 ppm (against $SiH_4$) | $SiH_4$ 200<br>$SiF_4$ 100<br>$H_2$ 300 |
| Substrate temperature (°C.) | 250 | 250 | 250 | 250 | 250 | 250 |
| RF power (W) | 200 | 400 | 300 | 250 | 300 | 400 |
| Internal pressure (torr) | 0.4 | 0.42 | 0.4 | 0.4 | 0.4 | 0.38 |
| Layer thickness (μm) | 20 | 20 | 20 | 20 | 20 | 20 |

TABLE 28

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1201 | ○ | ◉ | ◉ | ○ | ◉ | ◉ | ○ | ○ | ○ |
| 1202 | ◉ | ○ | ◉ | ○ | ◉ | ◉ | ○ | ○ | ○ |
| 1203 | ○ | ○ | ◉ | ○ | ◉ | ◉ | ○ | ○ | ○ |
| 1204 | ◉ | ○ | ◉ | ○ | ◉ | ◉ | ○ | ○ | ○ |
| 1205 | ○ | ○ | ◉ | ○ | ◉ | ◉ | ○ | ○ | ○ |
| 1206 | ◉ | ○ | ◉ | ○ | ◉ | ◉ | ○ | ○ | ○ |

◉ Excellent
○ Good
Δ Practically applicable
x Poor

TABLE 29

| Drum No | 1301 | 1302 | 1303 | 1304 | 1305 | 1306 |
|---|---|---|---|---|---|---|
| Flow rate | $SiH_4$ 150 | $SiH_4$ 150 | $SiH_4$ 150 | $SiH_4$ 150 | $SiH_4$ 150 | $SiH_4$ 100 |

TABLE 29-continued

| Drum No | 1301 | 1302 | 1303 | 1304 | 1305 | 1306 |
|---|---|---|---|---|---|---|
| (SCCM) | $B_2H_6$ 500 ppm (against $SiH_4$)<br>NO 10<br>$H_2$ 350 | $B_2H_6$ 100 ppm (against $SiH_4$)<br>NO 5<br>$H_2$ 350 | $PH_3$ 100 ppm (against $SiH_4$)<br>NO 5<br>$H_2$ 350 | $B_2H_6$ 500 ppm (against $SiH_4$)<br>NO 10<br>Ar 350 | $B_2H_6$ 1000 ppm (against $SiH_4$)<br>NO 10<br>He 350 | $SiF_4$ 50<br>$B_2H_6$ 500 ppm (against $SiH_4$)<br>NO 10<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness (μm) | 3 | 3 | 3 | 3 | 3 | 2.7 |
| Remarks | | | | | The conditions for the formation of the photoconductive layer are the same as in the case of the drum No. 1205 | |

TABLE 30

| Drum No. | Initial electrification efficiency | Initial sensitivity | Image flow | Interference fringe | Residual voltage | Ghost | Defective image | Deterioration of sensitivity | Increase of defective image | Remarks |
|---|---|---|---|---|---|---|---|---|---|---|
| 1301 | ◎ | ○ | ○ | ○ | ◎ | ◎ | ○ | ○ | ○ | (—) electrification |
| 1302 | ○ | ○ | ◎ | ○ | ◎ | ◎ | ○ | ○ | ○ | |
| 1303 | ○ | ○ | ○ | ○ | ○ | ○ | ○ | ○ | ○ | |
| 1304 | ◎ | ○ | ○ | ○ | ◎ | ◎ | ○ | ○ | ○ | |
| 1305 | ○ | ○ | ◎ | ○ | ◎ | ◎ | ○ | ○ | ○ | |
| 1306 | ◎ | ○ | ○ | ○ | ○ | ○ | ○ | ○ | ○ | |

TABLE 31

| Drum No. | 1401 | 1402 | 1403 | 1404 | 1405 | 1406 |
|---|---|---|---|---|---|---|
| Flow rate (SCCM) | $SiH_4$ 150<br>$B_2H_6$ 500 ppm (against $SiH_4$)<br>NO 10 → 0<br>$H_2$ 350 | $SiH_4$ 150<br>$B_2H_6$ 100 ppm (against $SiH_4$)<br>NO 5 → 0<br>$H_2$ 350 | $SiH_4$ 150<br>$PH_3$ 100 ppm (against $SiH_4$)<br>NO 5 → 0<br>$H_2$ 350 | $SiH_4$ 150<br>$B_2H_6$ 500 ppm (against $SiH_4$)<br>NO 10 → 0<br>Ar 350 | $SiH_4$ 150<br>$B_2H_6$ 1000 ppm (against $SiH_4$)<br>NO 10 → 0<br>He 350 | $SiH_4$ 100<br>$SiF_4$ 50<br>$B_2H_6$ 500 ppm (against $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness (μm) | 3 | 3 | 3 | 3 | 3 | 2.7 |
| Remarks | | | | | The conditions for the formation of the photoconductive layer are the same as in the case the drum No. 405 | |

TABLE 32

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1401 | ◎ | ○ | ○ | ◎ | ◎ | ◎ | ◎ | ○ | ◎ |
| 1402 | ○ | ○ | ◎ | ○ | ◎ | ◎ | ○ | ○ | ○ |
| 1403 | ○ | ○ | ○ | ○ | ◎ | ◎ | ○ | ○ | ○ |
| 1404 | ◎ | ○ | ○ | ◎ | ◎ | ○ | ○ | ○ | ○ |
| 1405 | ○ | ○ | ◎ | ◎ | ◎ | ◎ | ◎ | ○ | ◎ |

TABLE 32-continued

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1406 | ◉ | ○ | ○ | ◉ | ◉ | ○ | ○ | ○ | ○ |

◉ Excellent
○ Good
Δ Practically applicable
x Poor

TABLE 33

| Drum No. | 1501 | 1502 | 1503 | 1504 | 1505-1 | 1505-2 | 1506 |
|---|---|---|---|---|---|---|---|
| Flow rate (SCCM) | $SiH_4$ 150 | $SiH_4$ 150 | $SiH_4$ 150 | $SiH_4$ 150 | $SiH_4$ 150 | | $SiH_4$ 100 |
| | | | | | | | $SiF_4$ 50 |
| | $B_2H_6$ 1000 ppm (against $SiH_4$) | $B_2H_6$ 500 ppm (against $SiH_4$) | $PH_3$ 100 ppm (against $SiH_4$) | $B_2H_6$ 500 ppm (against $SiH_4$) | $B_2H_6$ 1000 ppm (against $SiH_4$) | | $B_2H_6$ 1000 ppm (against $SiH_4$) |
| | NO 10 | NO 5 | NO 5 | NO 10 | NO 10 | | NO 10 |
| | $GeH_4$ 30 | $GeH_4$ 50 | $GeH_4$ 70 | $GeH_4$ 10 | $GeH_4$ 50 | | $GeH_4$ 50 |
| | $H_2$ 350 | $H_2$ 350 | $H_2$ 350 | Ar 350 | He 350 | | $H_2$ 350 |
| Substrate temperature (°C.) | 250 | 250 | 250 | 250 | 250 | | 250 |
| RF power (w) | 150 | 200 | 150 | 150 | 150 | | 150 |
| Internal pressure (torr) | 0.27 | 0.27 | 0.27 | 0.27 | 0.27 | | 0.27 |
| Layer thickness (μm) | 0.5 | 0.5 | 0.5 | 0.5 | 0.5 | | 0.4 |
| Remarks | | | | | * | ** | |

*The conditions for the formation of the photoconductive layer are the same as in the case of the drum No. 1205. The conditions for the formation of the charge injection inhibition layer are the same as in the case of the drum No. 1305

**The conditions for the formation of the photoconductive layer are the same as in the case of the drum No. 1205. The conditions for the formation of the charge injection inhibition layer are the same as in the case of the drum No. 1405.

TABLE 34

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1501 | ◉ | ○ | ○ | ○ | ◉ | ◉ | ○ | ○ | ○ |
| 1502 | ◉ | ○ | ◉ | ◉ | ◉ | ◉ | ○ | ○ | ○ |
| 1503 | ◉ | ○ | ○ | ○ | ◉ | ◉ | Δ | ○ | Δ |
| 1504 | ○ | ◉ | ○ | ○ | ◉ | ○ | ○ | ○ | ○ |
| 1505-1 | ○ | ○ | ◉ | ◉ | ◉ | ◉ | ○ | ○ | ○ |
| 1505-2 | ○ | ○ | ◉ | ◉ | ◉ | ◉ | ○ | ○ | ○ |
| 1506 | ◉ | ○ | ○ | ◉ | ◉ | ○ | ○ | ○ | ○ |

◉ Excellent
○ Good
Δ Practically applicable
x Poor

TABLE 35

| Drum No. | 1601 | 1602 | 1603 | 1604 | 1605-1 | 1605-2 | 1606 |
|---|---|---|---|---|---|---|---|
| Flow rate (SCCM) | $SiH_4$ 150 | $SiH_4$ 150 | $SiH_4$ 150 | $SiH_4$ 150 | $SiH_4$ 150 | | $SiH_4$ 100 |
| | | | | | | | $SiF_4$ 50 |
| | $B_2H_6$ 1000 ppm (against $SiH_4$) | $B_2H_6$ 500 ppm (against $SiH_4$) | $PH_3$ 100 ppm (against $SiH_4$) | $B_2H_6$ 500 ppm (against $SiH_4$) | $B_2H_6$ 1000 ppm (against $SiH_4$) | | $B_2H_6$ 1000 ppm (against $SiH_4$) |
| | NO 10 | NO 5 | NO 5 | NO 10 | NO 10 | | NO 10 |
| | $GeH_4$ 30 → 0 | $GeH_4$ 50 → 0 | $GeH_4$ 70 → 0 | $GeH_4$ 10 → 0 | $GeH_4$ 50 → 0 | | $GeH_4$ 50 → 0 |
| | $H_2$ 350 | $H_2$ 350 | $H_2$ 350 | Ar 350 | He 350 | | $H_2$ 350 |
| Substrate temperature (°C.) | 250 | 250 | 250 | 250 | 250 | | 250 |
| RF power (W) | 150 | 200 | 150 | 150 | 150 | | 150 |
| Internal pressure (torr) | 0.27 | 0.27 | 0.27 | 0.27 | 0.27 | | 0.27 |
| Layer thickness (μm) | 0.5 | 0.5 | 0.5 | 0.5 | 0.5 | | 0.4 |

TABLE 35-continued

| Drum No. | 1601 | 1602 | 1603 | 1604 | 1605-1 | 1605-2 | 1606 |
|---|---|---|---|---|---|---|---|
| Remarks | | | | | * | ** | |

*The conditions for the formation of the photoconductive layer are the same as in the case of the drum No. 1205. The conditions for the formation of the charge injection inhibition layer are the same as in the case of the drum No. 1305.
**The conditions for the formation of the photoconductive layer are the same as in the case of the drum No. 1205. The conditions for the formation of the charge injection inhibition layer are the same as in the case of the drum No. 1405

TABLE 36

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 1601 | ◎ | ○ | ○ | ◎ | ◎ | ◎ | ○ | ○ | ○ |
| 1602 | ◎ | ○ | ◎ | ◎ | ◎ | ◎ | ○ | ○ | ○ |
| 1603 | ◎ | ○ | ○ | ◎ | ◎ | ◎ | ○ | ○ | ○ |
| 1604 | ○ | ○ | ○ | ○ | ◎ | ○ | ○ | ○ | ○ |
| 1605-1 | ○ | ○ | ◎ | ◎ | ◎ | ◎ | ○ | ○ | ○ |
| 1605-2 | ○ | ○ | ◎ | ◎ | ◎ | ◎ | ○ | ○ | ○ |
| 1606 | ◎ | ○ | ○ | ◎ | ◎ | ○ | ○ | ○ | ○ |

◎Excellent
○ Good
Δ Practically applicable
x Poor

TABLE 37

| Drum No. | 1701 | 1702 | 1703 | 1704 | 1705 |
|---|---|---|---|---|---|
| a [μm] | 25 | 50 | 50 | 12 | 12 |
| b [μm] | 0.8 | 2.5 | 0.8 | 1.5 | 0.3 |

TABLE 39

| Drum No. | 1801 | 1802 | 1803 | 1804 | 1805 |
|---|---|---|---|---|---|
| c [μm] | 50 | 100 | 100 | 30 | 30 |
| d [μm] | 2 | 5 | 1.5 | 2.5 | 0.7 |

TABLE 38

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 1701 | ◎ | ○ | ◎ | ○ | ◎ | ◎ | ○ | ○ | ○ | ○ |
| 1702 | ◎ | ○ | ◎ | ◎ | ◎ | ◎ | ○ | ○ | ○ | Δ |
| 1703 | ◎ | ○ | ◎ | ○ | ◎ | ◎ | ○ | ○ | ○ | Δ |
| 1704 | ◎ | ○ | ◎ | ◎ | ◎ | ◎ | ○ | ○ | ○ | ○ |
| 1705 | ◎ | ○ | ◎ | ○ | ◎ | ◎ | ○ | ○ | ○ | Δ |

◎Excellent
○ Good
Δ Practically applicable
x Poor

TABLE 40

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 1801 | ◎ | ○ | ◎ | ◎ | ◎ | ◎ | ○ | ○ | ○ | Δ |
| 1802 | ◎ | ◎ | ◎ | ◎ | ◎ | ◎ | ○ | ○ | ○ | Δ |
| 1803 | ◎ | ○ | ◎ | ○ | ◎ | ◎ | ○ | ○ | ○ | Δ |
| 1804 | ◎ | ◎ | ◎ | ◎ | ◎ | ◎ | ○ | ○ | ○ | ○ |
| 1805 | ◎ | ○ | ◎ | ○ | ◎ | ◎ | ○ | ○ | ○ | ○ |

◎Excellent
○ Good
Δ Practically applicable
x Poor

TABLE 41

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 150 | 250 | 150 | 0.25 | 0.1 |
| | $B_2H_6$ (against $SiH_4$) | 1000 ppm | | | | |
| | NO | 10 | | | | |
| | $H_2$ | 350 | | | | |
| IR layer | $SiH_4$ | 150 | 250 | 150 | 0.27 | 0.5 |
| | $B_2H_6$ (against $SiH_4$) | 1000 ppm | | | | |
| | NO | 10 | | | | |
| | $GeH_4$ | 50 | | | | |

TABLE 41-continued

| Name of layer | Gas used and flow rate (SCCM) | | Substrate temperature (°C.) | RF power (W) | Internal pressure (torr) | Layer thickness (μm) |
|---|---|---|---|---|---|---|
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 500 | | | | |
| | $H_2$ | 500 | | | | |

TABLE 42

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| ◉ | ○ | ◉ | ○ | ◉ | ◉ | ◉ | ○ | ○ | 52 |

◉ Excellent
○ Good
Δ Practically applicable
x Poor

TABLE 43

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 150 | 250 | 150 | 0.25 | 0.1 |
| | $B_2H_6$ (against $SiH_4$) | 1000 ppm | | | | |
| | NO | 10 | | | | |
| | $H_2$ | 350 | | | | |
| IR layer | $SiH_4$ | 150 | 250 | 150 | 0.27 | 0.5 |
| | $B_2H_6$ (against $SiH_4$) | 1000 ppm | | | | |
| | NO | 10 | | | | |
| | $GeH_4$ | 50 | | | | |
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 150 | 100 | 0.7 | 0.5 |
| | $CH_4$ | 500 | | | | |
| | $H_2$ | 1000 | | | | |

TABLE 44

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| x | ○ | ○ | ○ | x | Δ | x | ○ | x | 87 |

◉ Excellent
○ Good
Δ Practically applicable
x Poor

TABLE 45

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 150 | 250 | 150 | 0.25 | 0.1 |
| | $B_2H_6$ (against $SiH_4$) | 1000 ppm | | | | |
| | NO | 10 | | | | |
| | $H_2$ | 350 | | | | |
| IR layer | $SiH_4$ | 150 | 250 | 150 | 0.27 | 0.5 |
| | $B_2H_6$ (against $SiH_4$) | 1000 ppm | | | | |
| | NO | 10 | | | | |
| | $GeH_4$ | 50 → 0 | | | | |

TABLE 45-continued

| Name of layer | Gas used and flow rate (SCCM) | | Substrate temperature (°C.) | RF power (W) | Internal pressure (torr) | Layer thickness (μm) |
|---|---|---|---|---|---|---|
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 → 0 | | | | |
| | $H_2$ | 350 | | | | |
| Photo-conductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 400 | | | | |
| | $H_2$ | 300 | | | | |

TABLE 46

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| ◎ | ○ | ◎ | ◎ | ◎ | ◎ | ◎ | ○ | ◎ | 43 |

◎ Excellent
○ Good
Δ Practically applicable
x Poor

TABLE 47

| Drum No. | 2101 | 2102 | 2103 | 2104 | 2105 | 2106 | Comparative Example 6 |
|---|---|---|---|---|---|---|---|
| Flow rate (SCCM) | $SiH_4$ 10<br>$CH_4$ 500<br>$H_2$ 300 | $SiH_4$ 10<br>$CH_4$ 500<br>$H_2$ 500 | $SiH_4$ 10<br>$CH_4$ 500<br>$H_2$ 700 | $SiH_4$ 10<br>$CH_4$ 500<br>$H_2$ 700 | $SiH_4$ 10<br>$CH_4$ 500<br>$H_2$ 700 | $SiH_4$ 10<br>$SiF_4$ 10<br>$CH_4$ 500<br>$H_2$ 500 | $SiH_4$ 10<br>$CH_4$ 500<br>$H_2$ 800 |
| Substrate temperature (°C.) | 250 | 250 | 250 | 150 | 150 | 250 | 100 |
| RF power (W) | 200 | 100 | 200 | 200 | 100 | 200 | 150 |
| Internal pressure (torr) | 0.4 | 0.45 | 0.48 | 0.48 | 0.48 | 0.46 | 0.65 |
| Layer thickness (μm) | 0.5 | 0.5 | 0.5 | 0.5 | 0.5 | 0.5 | 0.5 |

TABLE 48

| Drum No. | Initial electrification efficiency | Initial sensitivity | Image flow | Interference fringe | Residual voltage | Ghost | Defective image | Deterioration of sensitivity | Increase of defective image | Sample No | Hydrogen content (atomic %) |
|---|---|---|---|---|---|---|---|---|---|---|---|
| 2101 | ◎ | ○ | ○ | ○ | ◎ | ◎ | ○ | ○ | ○ | 2101-1 | 43 |
| 2102 | ◎ | ○ | ◎ | ○ | ◎ | ◎ | ◎ | ○ | ○ | 2102-1 | 58 |
| 2103 | ○ | ○ | ◎ | ○ | ◎ | ◎ | ○ | ○ | ○ | 2103-1 | 61 |
| 2104 | ○ | ○ | ◎ | ○ | ○ | ◎ | ◎ | ○ | ○ | 2104-1 | 66 |
| 2015 | ○ | ○ | ○ | ○ | ○ | ○ | ○ | ○ | ○ | 2105-1 | 69 |
| 2106 | ◎ | ○ | ◎ | ○ | ◎ | ◎ | ◎ | ◎ | ○ | 2106-1 | 56 |
| Comparative Example 6 | x | ○ | ○ | ○ | x | Δ | x | ○ | x | Comparative Example 6-1 | 85 |

◎ Excellent
○ Good
Δ Practically applicable
x Poor

TABLE 49

| Drum No. | 401 | 402 | 403 | 404 | 405 | 406 |
|---|---|---|---|---|---|---|
| Flow rate (SCCM) | $SiH_4$ 350<br>$H_2$ 350 | $SiH_4$ 200<br>$H_2$ 600 | $SiH_4$ 350<br>$H_2$ 350<br>$B_2H_6$ 0.3 ppm (against $SiH_4$) | $SiH_4$ 350<br>Ar 350 | $SiH_4$ 350<br>He 350<br>$B_2H_6$ 0.3 ppm (against $SiH_4$) | $SiH_4$ 200<br>$SiF_4$ 100<br>$H_2$ 300 |
| Substrate temperature (°C.) | 250 | 250 | 250 | 250 | 250 | 250 |

TABLE 49-continued

| Drum No. | 401 | 402 | 403 | 404 | 405 | 406 |
|---|---|---|---|---|---|---|
| RF power (W) | 200 | 400 | 300 | 250 | 300 | 400 |
| Internal pressure (torr) | 0.4 | 0.42 | 0.4 | 0.4 | 0.4 | 0.38 |
| Layer thickness (μm) | 20 | 20 | 20 | 20 | 20 | 20 |

TABLE 50

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 2201 | ○ | ◎ | ◎ | ○ | ◎ | ◎ | ◎ | ○ | ○ |
| 2202 | ◎ | ○ | ◎ | ○ | ◎ | ◎ | ◎ | ○ | ○ |
| 2203 | ○ | ○ | ◎ | ○ | ◎ | ◎ | ○ | ○ | ○ |
| 2204 | ◎ | ○ | ◎ | ○ | ◎ | ◎ | ◎ | ○ | ○ |
| 2205 | ○ | ○ | ◎ | ○ | ◎ | ◎ | ◎ | ○ | ○ |
| 2206 | ◎ | ○ | ◎ | ○ | ◎ | ◎ | ◎ | ○ | ○ |

◎ Excellent
○ Good
Δ Practically applicable
x Poor

TABLE 51

| Drum No. | 2301 | 2302 | 2303 | 2304 | 2305 | 2306 |
|---|---|---|---|---|---|---|
| Flow rate (SCCM) | $SiH_4$ 150<br>$B_2H_6$ 500 ppm (against $SiH_4$)<br>NO 10<br>$H_2$ 350 | $SiH_4$ 150<br>$B_2H_6$ 100 ppm (against $SiH_4$)<br>NO 5<br>$H_2$ 350 | $SiH_4$ 150<br>PH 100 ppm (against $SiH_4$)<br>NO 5<br>$H_2$ 350 | $SiH_4$ 150<br>$B_2H_6$ 500 ppm (against $SiH_4$)<br>NO 10<br>Ar 350 | $SiH_4$ 150<br>$B_2H_6$ 1000 ppm (against $SiH_4$)<br>NO 10<br>He 350 | $SiH_4$ 100<br>$SiF_4$ 50<br>$B_2H_6$ 500 ppm (against $SiH_4$)<br>NO 10<br>$H_2$ 350 |
| Substrate temperature (°C.) | 250 | 250 | 250 | 250 | 250 | 250 |
| RF power (W) | 150 | 150 | 150 | 150 | 150 | 150 |
| Internal pressure (torr) | 0.25 | 0.25 | 0.25 | 0.25 | 0.25 | 0.25 |
| Layer thickness (μm) | 3 | 3 | 3 | 3 | 3 | 2.7 |
| Remarks | | | | | * | |

*The conditions for the formation of the photoconductive layer are the same as in the case of the drum No. 2205.

TABLE 52

| Drum No. | Initial electrification efficiency | Initial sensitivity | Image flow | Interference fringe | Residual voltage | Ghost | Defective image | Deterioration of sensitivity | Increase of defective image | Remarks |
|---|---|---|---|---|---|---|---|---|---|---|
| 2301 | ◎ | ○ | ○ | ○ | ◎ | ◎ | ◎ | ○ | ○ | (—) |
| 2302 | ○ | ○ | ◎ | ○ | ◎ | ◎ | ◎ | ○ | ○ | electrification |
| 2303 | ○ | ○ | ○ | ○ | ○ | ○ | ○ | ○ | ○ | |
| 2304 | ◎ | ○ | ○ | ○ | ◎ | ○ | ◎ | ○ | ○ | |
| 2305 | ○ | ○ | ◎ | ○ | ◎ | ◎ | ◎ | ○ | ○ | |
| 2306 | ◎ | ○ | ○ | ○ | ○ | ○ | ◎ | ○ | ○ | |

TABLE 53

| Drum No. | 2401 | 2402 | 2403 | 2404 | 2405 | 2406 |
|---|---|---|---|---|---|---|
| Flow rate (SCCM) | $SiH_4$ 150<br>$B_2H_6$ 500 ppm → 0 (against $SiH_4$)<br>NO 10 → 0<br>$H_2$ 350 | $SiH_4$<br>$B_2H_6$ 100 ppm → 0 (against $SiH_4$)<br>NO 5 → 0<br>$H_2$ 350 | $SiH_4$<br>PH 100 ppm → 0 (against $SiH_4$)<br>NO 5 → 0<br>$H_2$ 350 | $SiH_4$<br>$B_2H_6$ 500 ppm → 0 (against $SiH_4$)<br>NO 10 → 0<br>Ar 350 | $SiH_4$<br>$B_2H_6$ 1000 ppm → 0 (against $SiH_4$)<br>NO 10 → 0<br>He 350 | $SiH_4$ 100<br>$SiF_4$ 50<br>$B_2H_6$ 500 ppm → 0 (against $SiH_4$)<br>NO 10 → 0<br>$H_2$ 350 |
| Substrate temperature (°C.) | 250 | 250 | 250 | 250 | 250 | 250 |
| RF power (W) | 150 | 150 | 150 | 150 | 150 | 150 |

TABLE 53-continued

| Drum No. | 2401 | 2402 | 2403 | 2404 | 2405 | 2406 |
|---|---|---|---|---|---|---|
| Internal pressure (torr) | 0.25 | 0.25 | 0.25 | 0.25 | 0.25 | 0.25 |
| Layer thickness (μm) | 3 | 3 | 3 | 3 | 3 | 2.7 |
| Remarks | | | | | * | |

*The conditions for the formation of the photoconductive layer are the same as in the case of the drum No. 2205.

TABLE 54

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 2401 | ○ | ○ | ○ | ◎ | ◎ | ◎ | ◎ | ○ | ○ |
| 2402 | ○ | ○ | ◎ | ○ | ◎ | ◎ | ◎ | ○ | ○ |
| 2403 | ○ | ○ | ○ | ○ | ◎ | ◎ | ○ | ○ | ○ |
| 2404 | ○ | ○ | ○ | ◎ | ◎ | ○ | ◎ | ○ | ○ |
| 2405 | ◎ | ○ | ◎ | ◎ | ◎ | ○ | ◎ | ○ | ○ |
| 2406 | ◎ | ○ | ○ | ◎ | ◎ | ○ | ◎ | ○ | ○ |

◎Excellent
○ Good
Δ Practically applicable
x Poor

TABLE 55

| Drum No. | 2501 | 2502 | 2503 | 2504 | 2505-1/2505-2 | 2506 |
|---|---|---|---|---|---|---|
| Flow rate (SCCM) | $SiH_4$ 150 | $SiH_4$ 150 | $SiH_4$ 150 | $SiH_4$ 150 | $SiH_4$ 150 | $SiH_4$ 150 |
| | | | | | | $SiF_4$ 50 |
| | $B_2H_6$ 1000 ppm (against $SiH_4$) | $B_2H_6$ 500 ppm (against $SiH_4$) | $PH_3$ 100 ppm (against $SiH_4$) | $B_2H_6$ 500 ppm (against $SiH_4$) | $B_2H_6$ 1000 ppm (against $SiH_4$) | $B_2H_6$ 1000 ppm (against $SiH_4$) |
| | NO 10 | NO 5 | NO 5 | NO 10 | NO 10 | NO 10 |
| | $GeH_4$ 30 | $GeH_4$ 50 | $GeH_4$ 70 | $GeH_4$ 10 | $GeH_4$ 50 | $GeH_4$ 50 |
| | $H_2$ 350 | $H_2$ 350 | $H_2$ 350 | Ar 350 | He 350 | $H_2$ 350 |
| Substrate temperature (°C.) | 250 | 250 | 250 | 250 | 250 | 250 |
| RF power (W) | 150 | 200 | 150 | 150 | 150 | 150 |
| Internal pressure (torr) | 0.27 | 0.27 | 0.27 | 0.27 | 0.27 | 0.27 |
| Layer thickness (μm) | 0.5 | 0.5 | 0.5 | 0.5 | 0.5 | 0.4 |
| Remarks | | | | | * ** | |

*The conditions for the formation of the photoconductive layer are the same as in the case of the drum No. 2205. The conditions for the formation of the charge injection inhibition layer are the same as in the case of the drum No. 2305.
**The conditions for the formation of the photoconductive layer are the same as in the case of the drum No. 2205. The conditions for the formation of the charge injection inhibition layer are the same as in the case of the drum No. 2405.

TABLE 56

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 2501 | ◎ | ○ | ○ | ○ | ◎ | ◎ | ◎ | ○ | ○ |
| 2502 | ◎ | ○ | ◎ | ◎ | ◎ | ◎ | ◎ | ○ | ○ |
| 2503 | ◎ | ○ | ○ | ○ | ◎ | ◎ | ○ | ○ | ○ |
| 2504 | ○ | ○ | ○ | ○ | ◎ | ○ | ◎ | ○ | ○ |
| 2505-1 | ○ | ○ | ◎ | ○ | ◎ | ◎ | ◎ | ○ | ○ |
| 2505-2 | ○ | ○ | ◎ | ◎ | ◎ | ◎ | ◎ | ○ | ○ |
| 2506 | ◎ | ○ | ○ | ◎ | ◎ | ○ | ◎ | ○ | ○ |

◎Excellent
○ Good
Δ Practically applicable
x Poor

TABLE 57

| Drum No. | 2601 | 2602 | 2603 | 2604 | 2605-1/2605-2 | 2606 |
|---|---|---|---|---|---|---|
| Flow rate (SCCM) | $SiH_4$ 150 | $SiH_4$ 150 | $SiH_4$ 150 | $SiH_4$ 150 | $SiH_4$ 150 | $SiH_4$ 100 |
| | | | | | | $SiF_4$ 50 |
| | $B_2H_6$ 1000 ppm | $B_2H_6$ 500 ppm | $PH_3$ 100 ppm | $B_2H_6$ 500 ppm | $B_2H_6$ 1000 ppm | $B_2H_6$ 1000 ppm |

TABLE 57-continued

| Drum No. | 2601 | 2602 | 2603 | 2604 | 2605-1/2605-2 | 2606 |
|---|---|---|---|---|---|---|
| | (against $SiH_4$) | (against $SiH_4$) | (against $SiH_4$) | (against $SiH_4$) | (against $SiH_4$) | (against $SiH_4$) |
| | NO 10 | NO 5 | NO 5 | NO 10 | NO 10 | NO 10 |
| | $GeH_4$ 30 → 0 | $GeH_4$ 50 → 0 | $GeH_4$ 70 → 0 | $GeH_4$ 10 → 0 | $GeH_4$ 50 → 0 | $GeH_4$ 50 → 0 |
| | $H_2$ 350 | $H_2$ 350 | $H_2$ 350 | Ar 350 | He 350 | $H_2$ 350 |
| Substrate temperature (°C.) | 250 | 250 | 250 | 250 | 250 | 250 |
| RF power (W) | 150 | 200 | 150 | 150 | 150 | 150 |
| Internal pressure (torr) | 0.27 | 0.27 | 0.27 | 0.27 | 0.27 | 0.27 |
| Layer thickness (μm) | 0.5 | 0.5 | 0.5 | 0.5 | 0.5 | 0.5 |
| Remarks | | | | | * ** | |

*The conditions for the formation of the photoconductive layer are the same as in the case of the drum No. 2205. The conditions for the formation of the charge injection inhibition layer are the same as in the case of the drum No. 2305

**The conditions for the formation of the photoconductive layer are the same as in the case of the drum No. 2205. The conditions for the formation of the charge injection inhibition layer are the same as in the case of the drum No. 2405.

TABLE 58

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 2601 | ◉ | ○ | ○ | ◉ | ◉ | ◉ | ◉ | ○ | ○ |
| 2602 | ◉ | ○ | ◉ | ◉ | ◉ | ◉ | ◉ | ○ | ○ |
| 2603 | ◉ | ○ | ○ | ◉ | ◉ | ◉ | ○ | ○ | ○ |
| 2604 | ○ | ◉ | ○ | ○ | ◉ | ○ | ◉ | ○ | ◉ |
| 2605-1 | ○ | ○ | ◉ | ◉ | ◉ | ◉ | ◉ | ○ | ○ |
| 2605-2 | ○ | ○ | ◉ | ◉ | ◉ | ◉ | ◉ | ○ | ○ |
| 2606 | ◉ | ○ | ○ | ◉ | ◉ | ○ | ◉ | ○ | ○ |

◉ Excellent
○ Good
Δ Practically applicable
x Poor

TABLE 59

| | Drum No. | | | | | | | | | | | | | | | | | |
|---|---|---|---|---|---|---|---|---|---|---|---|---|---|---|---|---|---|---|
| | 2701 | | 2702 | | 2703 | | 2704 | | 2705 1 | 2705 2 | 2705 3 | 2705 4 | 2706 | |
| Flow rate (SCCM) | $SiH_4$ | 150 | $SiH_4$ | 150 | $SiH_4$ | 150 | $SiH_4$ | 150 | $SiH_4$ | | 150 | | $SiH_4$ | 100 |
| | | | | | | | | | | | | | $SiF_4$ | 50 |
| | $B_2H_6$ | 1000 ppm | $B_2H_6$ | 500 ppm | $PH_3$ | 100 ppm | $B_2H_6$ | 500 ppm | $B_2H_6$ | | 500 ppm | | $B_2H_6$ | 1000 ppm |
| | (against $SiH_4$) | | (against $SiH_4$) | | (against $SiH_4$) | | (against $SiH_4$) | | (against $SiH_4$) | | | | (against $SiH_4$) | |
| | NO | 10 | NO | 30 | NO | 10 | NO | 5 | NO | | 10 | | NO | 10 |
| | $H_2$ | 350 | $H_2$ | 350 | $H_2$ | 350 | Ar | 350 | He | | 350 | | $H_2$ | 350 |
| Substrate temperature (°C.) | 250 | | 250 | | 250 | | 250 | | 250 | | | | 250 | |
| RF power (W) | 150 | | 150 | | 150 | | 150 | | 150 | | | | 150 | |
| Internal pressure (torr) | 0.25 | | 0.25 | | 0.25 | | 0.25 | | 0.25 | | | | 0.25 | |
| Layer thickness (μm) | 0.1 | | 0.1 | | 0.1 | | 0.1 | | 0.1 | | | | 0.1 | |
| Remarks | | | | | | | | | (1) | (2) | (3) | (4) | | |

(1) (2) (3) (4): The conditions for the formation of the IR layer in the cases (1) (2) (3) and (4) are the same as in the case of the drum No. 705. No. 705. No. 805, and No. 805, respectively.

TABLE 60

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 2701 | ◉ | ○ | ○ | ○ | ◉ | ◉ | ◉ | ○ | ○ |
| 2702 | ◉ | ○ | ◉ | ○ | ◉ | ◉ | ◉ | ○ | ○ |
| 2703 | ◉ | ○ | ○ | ○ | ◉ | ◉ | ◉ | ○ | ○ |
| 2704 | ◉ | ○ | ○ | ○ | ◉ | ◉ | ◉ | ○ | ○ |
| 2705-1 | ○ | ○ | ◉ | ○ | ◉ | ◉ | ◉ | ○ | ○ |
| 2705-2 | ○ | ○ | ◉ | ◉ | ◉ | ◉ | ◉ | ○ | ○ |
| 2705-3 | ○ | ○ | ◉ | ◉ | ◉ | ◉ | ◉ | ○ | ○ |
| 2705-4 | ○ | ○ | ◉ | ◉ | ◉ | ◉ | ◉ | ○ | ○ |

TABLE 60-continued

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 2706 | ◉ | ○ | ○ | ○ | ◉ | ◉ | ◉ | ○ | ○ |

◉ Excellent
○ Good
Δ Practically applicable
x Poor

TABLE 61

| Drum No. | 2801 | 2802 | 2803 | 2804 | 2805 |
|---|---|---|---|---|---|
| a [μm] | 25 | 50 | 50 | 12 | 12 |
| b [μm] | 0.8 | 2.5 | 0.8 | 1.5 | 0.3 |

TABLE 63

| Drum No. | 2901 | 2902 | 2903 | 2904 | 2905 |
|---|---|---|---|---|---|
| c [μm] | 50 | 100 | 100 | 30 | 30 |
| d [μm] | 2 | 5 | 1.5 | 2.5 | 0.7 |

TABLE 62

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 2801 | ◉ | ○ | ◉ | ○ | ◉ | ◉ | ◉ | ○ | ○ | ○ |
| 2802 | ◉ | ○ | ◉ | ◉ | ◉ | ◉ | ◉ | ○ | ○ | Δ |
| 2803 | ◉ | ○ | ◉ | ○ | ◉ | ◉ | ◉ | ○ | ○ | Δ |
| 2804 | ◉ | ○ | ◉ | ◉ | ◉ | ◉ | ○ | ○ | ○ | ○ |
| 2805 | ◉ | ○ | ◉ | ○ | ◉ | ◉ | ○ | ○ | ○ | Δ |

◉ Excellent
○ Good
Δ Practically applicable
x Poor

TABLE 64

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 2901 | ◉ | ○ | ◉ | ◉ | ◉ | ◉ | ◉ | ○ | ○ | Δ |
| 2902 | ◉ | ○ | ◉ | ◉ | ◉ | ◉ | ○ | ○ | ○ | Δ |
| 2903 | ◉ | ○ | ◉ | ○ | ◉ | ◉ | ◉ | ○ | ○ | Δ |
| 2904 | ◉ | ○ | ◉ | ◉ | ◉ | ◉ | ◉ | ○ | ○ | ○ |
| 2905 | ◉ | ○ | ◉ | ○ | ◉ | ◉ | ○ | ○ | ○ | ○ |

◉ Excellent
○ Good
Δ Practically applicable
x Poor

TABLE 65

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 150 | 250 | 150 | 0.25 | 0.1 |
| | $B_2H_6$ (against $SiH_4$) | 1000 ppm | | | | |
| | NO | 10 | | | | |
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 10 | 250 | 200 | 0.45 | 0.5 |
| | $CH_4$ | 500 | | | | |
| | $H_2$ | 500 | | | | |

TABLE 66

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| ◉ | ○ | ◉ | ○ | ◉ | ◉ | ◉ | ○ | ○ | 52 |

◉ Excellent
○ Good
Δ Practically applicable
x Poor

TABLE 67

| Name of layer | Gas used and flow rate (SCCM) | | Substrate temperature (°C.) | RF power (W) | Internal pressure (torr) | Layer thickness (μm) |
|---|---|---|---|---|---|---|
| Contact layer | $SiH_4$ | 150 | 250 | 150 | 0.25 | 0.1 |
| | $B_2H_6$ (against $SiH_4$) | 1000 ppm | | | | |
| | NO | 10 | | | | |
| | $H_2$ | 350 | | | | |
| Charge injection inhibition layer | $SiH_4$ | 150 | 250 | 150 | 0.25 | 3 |
| | $B_2H_6$ (against $SiH_4$) | 1000 ppm | | | | |
| | NO | 10 | | | | |
| | $H_2$ | 350 | | | | |
| Photoconductive layer | $SiH_4$ | 350 | 250 | 300 | 0.4 | 20 |
| | $H_2$ | 350 | | | | |
| Surface layer | $SiH_4$ | 10 | 150 | 100 | 0.7 | 0.5 |
| | $CH_4$ | 500 | | | | |
| | $H_2$ | 1000 | | | | |

TABLE 68

| Initial electrification efficiency | Initial sensitivity | Image flow | Interference fringe | Residual voltage | Ghost | Defective image | Deterioration of sensitivity | Increase of defective image | Hydrogen content (atomic %) |
|---|---|---|---|---|---|---|---|---|---|
| x | ○ | ○ | ○ | x | Δ | x | ○ | x | 87 |

◉ Excellent
○ Good
Δ Practically applicable
x Poor

What we claim is:

1. A light receiving member for use in electrophotography comprising a substrate for electrophotography and a light receiving layer constituted by a charge injection inhibition layer, a photoconductive layer and a surface layer, the charge injection inhibition layer being formed of an amorphous material containing silicon atoms as the main constituent atoms and an element for controlling the conductivity, the photoconductive layer being formed of an amorphous material containing silicon atoms as the main constituent atoms and at least one kind selected from hydrogen atoms and halogen atoms and the surface layer being formed of an amorphous material containing silicon atoms, carbon atoms and hydrogen atoms, and the amount of the hydrogen atoms contained in the surface layer being in the range of 41 to 70 atomic %.

2. A light receiving member for use in electrophotography according to claim 1, wherein the photoconductive layer contains at least one kind selected from nitrogen atoms and oxygen atoms.

3. A light receiving member for use in electrophotography according to claim 1 or 2, wherein the charge injection inhibition layer contains at least one kind selected from nitrogen atoms, oxygen atoms and carbon atoms.

4. A light receiving member for use in electrophotography according to claim 1, wherein the charge injection inhibition layer contains the element for controlling the conductivity in the state of being largely distributed in the side of the substrate.

5. A light receiving member for use in electrophotography according to claim 3, wherein the charge injection inhibition layer contains at least one kind selected from nitrogen atoms, oxygen atoms and carbon atoms in the state of being more largely distributed in the layer region near substrate.

6. A light receiving member for use in electrophotography according to claim 3, wherein the charge injection inhibition layer contains at least one kind selected from nitrogen atoms, hydrogen atoms and carbon atoms only in the layer region adjacent to the substrate.

7. A light receiving member for use in electrophotography according to claim 1, wherein an absorption layer for light of long wavelength formed of an amorphous material containing silicon atoms and germanium atoms is disposed between the substrate and the charge injection inhibition layer.

8. A light receiving member for use in electrophotography according to claim 7, wherein the absorption layer for light of long wavelength contains one kind selected from element for controlling the conductivity, nitrogen atoms, oxygen atoms and carbon atoms.

9. A light recieving member for use in electrophotography according to claim 1, 4 or 8, wherein the element for controlling the conductivity is an atom belonging the group III of the periodic table.

10. A light receiving member for us in electrophotography according to claim 1, 4 or 8, wherein the element for controlling the conductivity is an atom belonging the group V of the periodic table.

11. A light receiving member for use in electrophotography according to claim 1, wherein a contact layer formed of an amorphous material containing silicon atoms and at least one kind selected from nitrogen atoms, oxygen atoms and carbon atoms is disposed between the substrate and the absorption layer for light of long wavelength or between the substrate and the charge injection inhibition layer.

12. An electrophotographic process comprising the steps of charging the light receiving member of claim 1, and thereafter, irradiating the light receiving member with an electromagnetic wave carrying information, thereby forming an electrostatic image.

* * * * *

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 1

Line 28, "office," should read --an office,--.
Line 36, "electro- photograpy" should read --electrophotograpy--.
Line 47, "such" should read --such a--.
Line 48, "in" should read --as--.
Line 51, "are" should read --is--.

COLUMN 2

Line 15, "much" should read --very--.
Line 21, "not" should read --so as not--.
Line 36, "repeating" should read --repeated--.
Line 60, "and quality." should read --and of high quality.--.

COLUMN 3

Lines 33-34, "is ranging" should read --ranges--.

COLUMN 4

Line 6, "on" should read --of--.
Line 18, "alone" should read --a lone--.
Line 19, "resistant" should be deleted.
Line 20, "cause" should read --causes--.
Line 21, "repeating" should read --repeated--.
Line 27, "quality" should read --of high quality--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 5

Line 34, "represntative" should read --representative--.

COLUMN 6

Line 31, "with" should read --by--.
Line 33, "bite." should read --bit.--.
Lines 40-41, "desirably" should read --desirable--.

COLUMN 7

Line 34, "meaning" should read --embodiment--.

COLUMN 8

Line 16, "graviationally" should read --gravitationally--.
Line 18, "and" should read --are--.
Line 52, "receving" should read --receiving--.
Line 55, "100" should read --2100--.

COLUMN 10

Line 5, "distributing" should read --distribution--.
Line 10, "inhibition" should read --inhibition layer--.
Line 11, "distributing" should read --distribution--.
Line 31, "is" should be deleted.

COLUMN 11

Line 53, "102" should read --102 (or 2102)--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 12

Line 6, "hydrogen" should read --halogen--.
Line 58, "$t_b$" should read --$t_B$--.

COLUMN 14

Line 13, "and" should read --to--.
Line 27, "As for the" should read --The--.
Line 41, "101 (or 2102)" should read --101 (or 2101)--.

COLUMN 15

Line 5, "or" should read --of--.
Line 5, "periodical" should read --periodic--.
Line 8, "periodical" should read --periodic--.
Line 23, "is" should read --are--.
Line 45, "(H)" should read --(X)--.
Line 53, "and" should read --are--.

COLUMN 16

Line 8, "repeating" should read --repeated--.
Line 33, "to in photoconductiveness" should read --to nonphotoconductiveness--.
Line 47, "repeating" should read --repeated--.

COLUMN 17

Line 11, "that is" should read --it is--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 18

Line 4, "kind atoms" should read --kinds of atoms--.
Line 38, "be" should be deleted.
Line 60, "ecample" should read --example--.

COLUMN 19

Line 42, "material" should read --materials--.
Line 56, "copable" should read --capable--.

COLUMN 20

Line 34, "gases material" should read --gas materials--.
Line 36, "being" should read --has been--.
Line 56, "to as the" should read --as--.

COLUMN 21

Line 47, "as for" should read --for--.

COLUMN 22

Line 25, "butine" should read --butyne--.
Line 64, "atoms." should read --atoms may be used.--.

COLUMN 23

Line 30, "is" should be deleted.
Line 30, "sputtered" should read --sputtering--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 24

Line 29, "insdie" should read --inside--.
Lines 37-38, "distributing" should read --distribution--.
Line 39, "properly" should read --desired--.
Line 56, "properly" should read --desired--.

COLUMN 25

Line 33, "Ar, He and He" should read --Ar and He--.
Line 41, "addtionally" should read --additionally--.
Line 45, "is" should read --are--.
Lines 51-52, "introducted" should read --introduced--.

COLUMN 26

Line 36, "gases material" should read --gas materials--.
Line 38, "being" should read --has been--.
Line 51, "SiGe(H,X)" should read --A-SiGe(H,X)--.
Line 54, "may be formed" should be deleted.

COLUMN 27

Line 6, "substance" should read --substances-- (both occurrences).
Line 26, "butine" should read --butyne--.
Line 57, "to" should be deleted.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 28

Line 39, "t" should read --to--.
Line 46, "inventtion," should read --invention,--.
Lines 58-59, "externally" should read --external--.

COLUMN 29

Line 9, "amnner" should read --manner--.
Line 31, "on" should read --an--.
Line 38, "insdie" should read --inside--.

COLUMN 30

Line 18, "butine" should read --butyne--.

COLUMN 31

Line 41, "vacuum" should read --vacuum gauge--.
Line 46, "photo" should read --light--.
Line 47, "3437" should read --2437--.
Line 66, "the 2437" should read --the substrate 2437--.
Line 66, "2448" should read --2438--.

COLUMN 32

Line 10, "gas into" should read --gas flow into--.
Line 20, "in" should read --is--.
Line 21, "in stead" should read --instead--.
Line 21, "of" should read --by--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 32 (continued)

Line 32, "in stead" should read --instead--.
Line 53, "upon" should be deleted.
Line 68, "appratus" should read --apparatus--.

COLUMN 33

Line 2, "kind" should read --kind of--.
Line 4, "kind" should read --kind of--.
Line 4, "a" should read --as--.
Line 7, "kind" should read --kind of--.
Line 10, "characteristic s" should read --characteristics--.
Line 11, "a" should be deleted.
Line 13, "on" should read --of--.
Line 14, "shots" should read --cycles--.
Line 37, "much" should read --many--.
Line 52, "kind" should read --kind of--.
Line 56, "a" should be deleted.
Line 58, "on" should read --of--.
Line 59, "shots" should read --cycles--.
Line 61, "or" should read --on--.

COLUMN 34

Line 18, "analysises" should read --analyses--.
Lines 34-35, "were under the same conditions as in Example 1 were provided." should read --were provided.--.
Line 63, "of bearing balls." should read --ball bearings.--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 35

Line 11, "And" should read --A--.
Line 12, "kind" should read --kind of--.
Line 23, "a" should be deleted.
Line 24, "on" should read --of--.
Line 26, "shots" should read --cycles--.
Line 26, "wer" should read --were--.
Line 33, "in" should be deleted.
Line 49, "much" should read --many--.
Line 59, "kind" should read --kind of--.

COLUMN 36

Line 2, "a" should be deleted.
Line 3, "on" should read --of--.
Line 5, "shots" should read --cycles--.

COLUMN 37

Line 18, "are" should read --were--.
Line 32, "are" should read --were--.
Line 43, "kind" should read --kind of--.
Line 48, "kind" should read --kind of--.
Line 54, "a" should be deleted.
Line 55, "on" should read --of--.
Line 57, "shots" should read --cycles--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 38

Line 12, "illustrate, much" should read --illustrates, many--.
Line 21, "apparatu" should read --apparatus--.
Line 23, "kind" should read --kind of--.
Line 25, "kind" should read --kind of--.
Line 34, "a" should be deleted.
Line 35, "on" should read --of--.

COLUMN 40

Line 12, "are" should read --were--.
Line 19, "grounded" should read --ground--.
Line 24, "kind" should read --kind of--.
Line 29, "kind" should read --kind of--.
Line 33, "a" should be deleted.
Line 35, "on" should read --of--.
Line 36, "shots" should read --cycles--.
Line 59, "much" should read --many--.

COLUMN 43

Table 8, " Initial electrifi cation " should read -- Initial electrifi- cation --.
Table 8, "Difective" should read --Defective--.

COLUMN 45

Table 11, "*only" should read --*Only--.
Table 13, "Only" should read --*Only--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 46

Table 12, "O (-) " should read --O --.

| | |
|---|---|
| O | O |
| O | electrifi- |
| O | cation |
| O | O |
| O | |
| O | O |
| | O |
| | O |
| | O |
| | (-) |
| | electrifi- |
| | cation |

COLUMN 47

Table 14,

"

| Image flow | Residual voltage | Ghost | Defective image | Deterio- ration of sensitivity |
|---|---|---|---|---|
| O | ◎ | ◎ | ◎ | O |
| ◎ | ◎ | ◎ | O | O |
| O | ◎ | ◎ | O | O |
| O | ◎ | O | O | O |
| ◎ | ◎ | ◎ | O | O |
| O | ◎ | O | O | O |

"

should read

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

--

| Image flow | Residual voltage | Ghost | Defective image | Deterio-ration of sensitivity |
|---|---|---|---|---|
| O | ◎ | ◎ | ◎ | O |
| ◎ | ◎ | ◎ | O | O |
| O | ◎ | ◎ | O | O |
| O | ◎ | O | O | O |
| ◎ | ◎ | ◎ | O | O |
| O | ◎ | O | O | O |

--.

COLUMNS 49-50

Table 20,

"

| Image flow | Inter-ference fringe | Residual voltage | Ghost | Defective image | Deterio-ration of sensitivity | Increase of defective image |
|---|---|---|---|---|---|---|
| ◎ | O | ◎ | ◎ | O | O | O |

"

should read

--

| Image flow | Inter-ference fringe | Residual voltage | Ghost | Defective image | Deterio-ration of sensitivity | Increase of defective image |
|---|---|---|---|---|---|---|
| ◎ | O | ◎ | ◎ | O | O | O |

--

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

Table 24,

| "Initial sensitivity | Image flow | Interference fringe | Residual voltage | Ghost | Defective image " |
|---|---|---|---|---|---|
| O | ⊙ | ⊙ | ⊙ | ⊙ | O |

should read

| --Initial sensitivity | Image flow | Interference fringe | Residual voltage | Ghost | Defective image --. |
|---|---|---|---|---|---|
| O | ⊙ | ⊙ | ⊙ | ⊙ | O |

COLUMNS 51-52

Table 28,

| " Interference fringe | Residual voltage | Ghost | Defective image | Deterioration of sensitivity " |
|---|---|---|---|---|
| O | ⊙ | ⊙ | O | O |
| O | ⊙ | ⊙ | O | O |
| O | ⊙ | ⊙ | O | O |
| O | ⊙ | ⊙ | O | O |
| O | ⊙ | ⊙ | O | O |
| O | ⊙ | ⊙ | O | O |

should read

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

--

| Interference fringe | Residual voltage | Ghost | Defective image | Deterioration of sensitivity |
|---|---|---|---|---|
| O | ◎ | ◎ | O | O |
| O | ◎ | ◎ | O | O |
| O | ◎ | ◎ | O | O |
| O | ◎ | ◎ | O | O |
| O | ◎ | ◎ | O | O |
| O | ◎ | ◎ | O | O |

--.

COLUMNS 53-54

Table 30,

"

| Image flow | Interference fringe | Residual voltage | Ghost | Defective image |
|---|---|---|---|---|
| O | O | ◎ | ◎ | O |
| ◎ | O | ◎ | ◎ | O |
| O | O | O | O | O |
| O | O | ◎ | ◎ | O |
| ◎ | O | ◎ | ◎ | O |
| O | O | O | O | O |

"

should read

It is certified that error appears in the above-identified patent and that said Letters Patent is hereby corrected as shown below:

--

| Image flow | Interference fringe | Residual voltage | Ghost | Defective image |
|---|---|---|---|---|
| O | O | ◎ | ◎ | O |
| ◎ | O | ◎ | ◎ | O |
| O | O | O | O | O |
| O | O | ◎ | O | O |
| ◎ | O | ◎ | ◎ | O |
| O | O | O | O | O |

--.

COLUMN 57

Table 36, "Initial" should read --Initial--.

| sensitivity | sensitivity |
|---|---|
| O | O |
| O | O |
| O | O |
| O | ◎ |
| O | O |
| O | O |
| O | O |

Table 38, "Sample" should read --Drum--.

| No. | No. |
|---|---|

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

Table 38, "

| Image flow | Interference fringe | Residual voltage | Ghost | Defective image | Deterioration of sensitivity |
|---|---|---|---|---|---|
| ◎ | | O | ◎ | ◎ | O |
| ◎ | | ◎ | ◎ | ◎ | O |
| ◎ | | O | ◎ | ◎ | O |
| ◎ | | ◎ | ◎ | ◎ | O |
| ◎ | | O | ◎ | ◎ | O |

" --

| Image flow | Interference fringe | Residual voltage | Ghost | Defective image | Deterioration of sensitivity |
|---|---|---|---|---|---|
| ◎ | O | ◎ | ◎ | O | O |
| ◎ | ◎ | ◎ | ◎ | O | O |
| ◎ | O | ◎ | ◎ | O | O |
| ◎ | ◎ | ◎ | ◎ | O | O |
| ◎ | O | ◎ | ◎ | O | O |

--.

COLUMN 57

Table 40, "Sample" should read --Drum--.
No. No.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

Table 40, "Initial" should read --Initial--.

| | |
|---|---|
| sensi-tivity | sensi-tivity |
| O | O |
| ◎ | O |
| O | O |
| ◎ | O |
| O | O |

COLUMNS 59-60

Table 42,

| " Initial electrifi-cation efficiency | Initial sensi-tivity | Image flow | Inter-ference fringe | Residual voltage | Ghost | Defective image | Deterio-ration of sensitivity | Increase of defective image " |
|---|---|---|---|---|---|---|---|---|
| ◎ | O | ◎ | O | ◎ | ◎ | ◎ | O | O |

should read

| -- Initial electrifi-cation efficiency | Initial sensi-tivity | Image flow | Inter-ference fringe | Residual voltage | Ghost | Defective image | Deterio-ration of sensitivity | Increase of defective image -- |
|---|---|---|---|---|---|---|---|---|
| ◎ | O | ◎ | O | ◎ | ◎ | ◎ | O | O |

PATENT NO. : 4,738,913
DATED : April 19, 1988
INVENTOR(S) : SHIGERU SHIRAI, ET AL.

It is certified that error appears in the above-identified patent and that said Letters Patent is hereby corrected as shown below:

COLUMNS 61-62

Table 46,

"

| Initial sensitivity | Image flow | Interference fringe | Residual voltage | Ghost | Defective image | Deterioration of sensitivity | Increase of defective image |
|---|---|---|---|---|---|---|---|
| O | ⊗ | ⊗ | ⊗ | ⊗ | ⊗ | O | ⊗ |

should read

--

| Initial sensitivity | Image flow | Interference fringe | Residual voltage | Ghost | Defective image | Deterioration of sensitivity | Increase of defective image |
|---|---|---|---|---|---|---|---|
| O | ⊗ | ⊗ | ⊗ | ⊗ | ⊗ | O | ⊗ |

--

COLUMN 62

Table 48, "Sample" should read --Sample--.
No No.

COLUMNS 61-62

Table 49,
"Drum No. 401 402 403 404 405 406"
should read
--Drum No. 2201 2202 2203 2204 2205 2206--.

COLUMN 63

Table 51, "PH" should read --$PH_3$--.
Table 53, "PH" should read --$PH_3$--.

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMN 64

Table 52, "image Remarks" should read --image Remarks--.

| | | | |
|---|---|---|---|
| O | (-) electrifi-cation | O | |
| O | | O | |
| O | | | (-) electrifi-cation |
| O | | O | |
| O | | | |
| O | | O | |
| | | O | |
| | | O | |

COLUMNS 63-64

Table 53,

| -- 2402 | | 2403 | | 2404 | | 2405 | -- |
|---|---|---|---|---|---|---|---|
| $SiH_4$ | | $SiH_4$ | | $SiH_4$ | | $SiH_4$ | |

should read

| -- 2402 | | 2403 | | 2404 | | 2405 | -- |
|---|---|---|---|---|---|---|---|
| $SiH_4$ | 150 | $SiH_4$ | 150 | $SiH_4$ | 150 | $SiH_4$ | 150 |

COLUMN 65

Table 54, "2404 O" should read --2404 ⊖--.
2405 ⊖ 2405 O

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

Table 54, "Ghost" should read --Ghost--.

| | |
|---|---|
| ⊖ | ⊖ |
| ⊖ | ⊖ |
| ⊖ | ⊖ |
| O | O |
| O | ⊖ |
| O | O |

Table 54, "Increase " should read --Increase --.

| | |
|---|---|
| Increase of defective image | Increase of defective image |
| O | ⊖ |

COLUMNS 65-66

Table 56, "

| Interference fringe | Residual voltage | Ghost | Defective image | Deterioration of sensitivity |
|---|---|---|---|---|
| O | ⊖ | ⊖ | ⊖ | O |
| ⊖ | ⊖ | ⊖ | ⊖ | O |
| O | ⊖ | ⊖ | O | O |
| O | ⊖ | O | ⊖ | O |
| O | ⊖ | ⊖ | ⊖ | O |
| ⊖ | ⊖ | ⊖ | ⊖ | O |
| ⊖ | ⊖ | O | ⊖ | O |

should read

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

-- Inter

| ference fringe | Residual voltage | Ghost | Defective image | Deterio- ration of sensitivity |
|---|---|---|---|---|
| O | ◎ | ◎ | ◎ | O |
| ◎ | ◎ | ◎ | ◎ | O |
| O | ◎ | ◎ | O | O |
| O | ◎ | O | ◎ | O |
| O | ◎ | ◎ | ◎ | O |
| ◎ | ◎ | ◎ | ◎ | O |
| ◎ | ◎ | O | ◎ | O |

--

COLUMNS 67-68

Table 58,

"

| Ghost | Defective image | Deterio- ration of sensitivity |
|---|---|---|
| ◎ | ◎ | O |
| ◎ | ◎ | O |
| ◎ | O | O |
| O | ◎ | O |
| ◎ | ◎ | O |
| ◎ | ◎ | O |
| O | ◎ | O |

"

should read

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

--

| Ghost | Defective image | Deterio- ration of sensitivity |
|---|---|---|
| ⊙ | ⊙ | O |
| ⊙ | ⊙ | O |
| ⊙ | O | O |
| O | ⊙ | O |
| ⊙ | ⊙ | O |
| ⊙ | ⊙ | O |
| O | ⊙ | O |

--

Table 59, "NO 5O" should read --NO 5--.

COLUMNS 69-70

Table 62,

| "flow | fringe | voltage | Ghost | image | sensitivity | image" |
|---|---|---|---|---|---|---|
| ⊙ | O | ⊙ | ⊙ | ⊙ | O | O |
| ⊙ | ⊙ | ⊙ | ⊙ | ⊙ | O | O |
| ⊙ | O | ⊙ | ⊙ | ⊙ | O | O |
| ⊙ | ⊙ | ⊙ | ⊙ | O | O | O |
| ⊙ | O | ⊙ | ⊙ | O | O | O |

should read

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

--

| flow | fringe | voltage | Ghost | image | sensitivity | image |
|---|---|---|---|---|---|---|
| ◎ | O | ◎ | ◎ | ◎ | O | O |
| ◎ | ◎ | ◎ | ◎ | ◎ | O | O |
| ◎ | O | ◎ | ◎ | ◎ | O | O |
| ◎ | ◎ | ◎ | ◎ | O | O | O |
| ◎ | O | ◎ | ◎ | O | O | O |

--

Table 64,

"

| fringe | voltage | Ghost | image | sensitivity | image |
|---|---|---|---|---|---|
| ◎ | ◎ | ◎ | ◎ | O | O |
| ◎ | ◎ | ◎ | O | O | O |
| O | ◎ | ◎ | ◎ | O | O |
| ◎ | ◎ | ◎ | ◎ | O | O |
| O | ◎ | ◎ | O | O | O |

"

should read

--

| fringe | voltage | Ghost | image | sensitivity | image |
|---|---|---|---|---|---|
| ◎ | ◎ | ◎ | ◎ | O | O |
| ◎ | ◎ | ◎ | O | O | O |
| O | ◎ | ◎ | ◎ | O | O |
| ◎ | ◎ | ◎ | ◎ | O | O |
| O | ◎ | ◎ | O | O | O |

--

UNITED STATES PATENT AND TRADEMARK OFFICE

CERTIFICATE OF CORRECTION

PATENT NO. : 4,738,913

DATED : April 19, 1988

INVENTOR(S) : SHIGERU SHIRAI, ET AL.

It is certified that error appears in the above-identified patent and that said Letters Patent is hereby corrected as shown below:

COLUMNS 71-72

Table 66,

"tivity flow fringe voltage Ghost image sensitivity image "

O ⊚ O ⊚ ⊚ ⊚ O O should read

--tivity flow fringe voltage Ghost image sensitivity image --

O ⊚ O ⊚ ⊚ ⊚ O O

COLUMN 72

Line 46, "substrate." should read --the substrate.--.
Line 61, "element" should read --the element--.
Line 67, "us" should read --use--.

Signed and Sealed this

Seventeenth Day of July, 1990

*Attest:*

*Attesting Officer*

HARRY F. MANBECK, JR.

*Commissioner of Patents and Trademarks*